US007001016B2

(12) United States Patent
Baxter et al.

(10) Patent No.: US 7,001,016 B2
(45) Date of Patent: Feb. 21, 2006

(54) METHOD AND APPARATUS FOR CREATING AN IMAGE ON AN ARTICLE AND PRINTED ARTICLE

(75) Inventors: William R. S. Baxter, Cambridge (GB); Richard W. Eve, Cambridge (GB); Karine A. Luetgert, Geneva, IL (US); Scott Fellin, Genevea, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

(21) Appl. No.: 10/405,040

(22) Filed: Apr. 2, 2003

(65) Prior Publication Data

US 2003/0218663 A1 Nov. 27, 2003

Related U.S. Application Data

(60) Provisional application No. 60/369,798, filed on Apr. 3, 2002.

(51) Int. Cl.
*B41J 2/01* (2006.01)

(52) U.S. Cl. ..... 347/101; 347/8; 347/9

(58) Field of Classification Search ..... 347/101, 347/100, 8, 9, 102; 428/534, 195, 32.1
See application file for complete search history.

(56) References Cited

U.S. PATENT DOCUMENTS

| | | | | |
|---|---|---|---|---|
| 4,849,768 | A | 7/1989 | Graham | |
| 5,455,607 | A | 10/1995 | Rhoads et al. | |
| 5,750,240 | A | 5/1998 | Findley et al. | |
| 5,757,389 | A | 5/1998 | Schwede et al. | |
| 5,873,315 | A | 2/1999 | Codos | |
| 5,908,667 | A | 6/1999 | Blum et al. | |
| 5,939,143 | A | 8/1999 | Findley et al. | |
| 6,145,979 | A | 11/2000 | Caiger et al. | |
| 6,450,602 | B1 * | 9/2002 | Lubinsky et al. | 347/8 |
| 6,460,958 | B1 | 10/2002 | Kubo et al. | |
| 6,523,921 | B1 | 2/2003 | Codos | |
| 6,592,672 | B1 | 7/2003 | Mizuno | |
| 6,759,105 | B1 | 7/2004 | Brooker et al. | |
| 2001/0017085 | A1 | 8/2001 | Kubo et al. | |
| 2001/0019340 | A1 | 9/2001 | Kubo et al. | |
| 2002/0001015 | A1 | 1/2002 | Kojima et al. | |
| 2002/0024544 | A1 | 2/2002 | Codos et al. | |
| 2002/0171692 | A1 | 11/2002 | Martin | |
| 2003/0020767 | A1 | 1/2003 | Saksa | |
| 2003/0136058 | A1 | 7/2003 | Winton | |

FOREIGN PATENT DOCUMENTS

| | | | |
|---|---|---|---|
| DE | 19808262 | A1 | 9/1999 |
| DE | 10031030 | A1 | 1/2002 |
| EP | 0710187 | B1 | 5/1996 |
| GB | 2289439 | A | 11/1995 |
| JP | 9-193368 | | 7/1997 |
| JP | 10-58668 | | 3/1998 |
| WO | WO 89/06889 | | 7/1989 |
| WO | WO 95/31343 | * | 11/1995 |
| WO | WO 02/18148 | A1 * | 3/2002 |

* cited by examiner

*Primary Examiner*—Manish S. Shah
(74) *Attorney, Agent, or Firm*—Berenato, White & Stavish, LLC

(57) ABSTRACT

A method of printing an image on an object includes the steps of: providing an object having an exterior surface having a planar portion and a channel recessed from the planar portion; applying a first ground coat on the exterior surface; drying the first ground coat; and spraying droplets of ink on the dried ground coat to form an image, wherein the droplets are sprayed from an ink jet printhead that is maintained at a constant distance from the plane of the planar portion of the object.

75 Claims, 18 Drawing Sheets

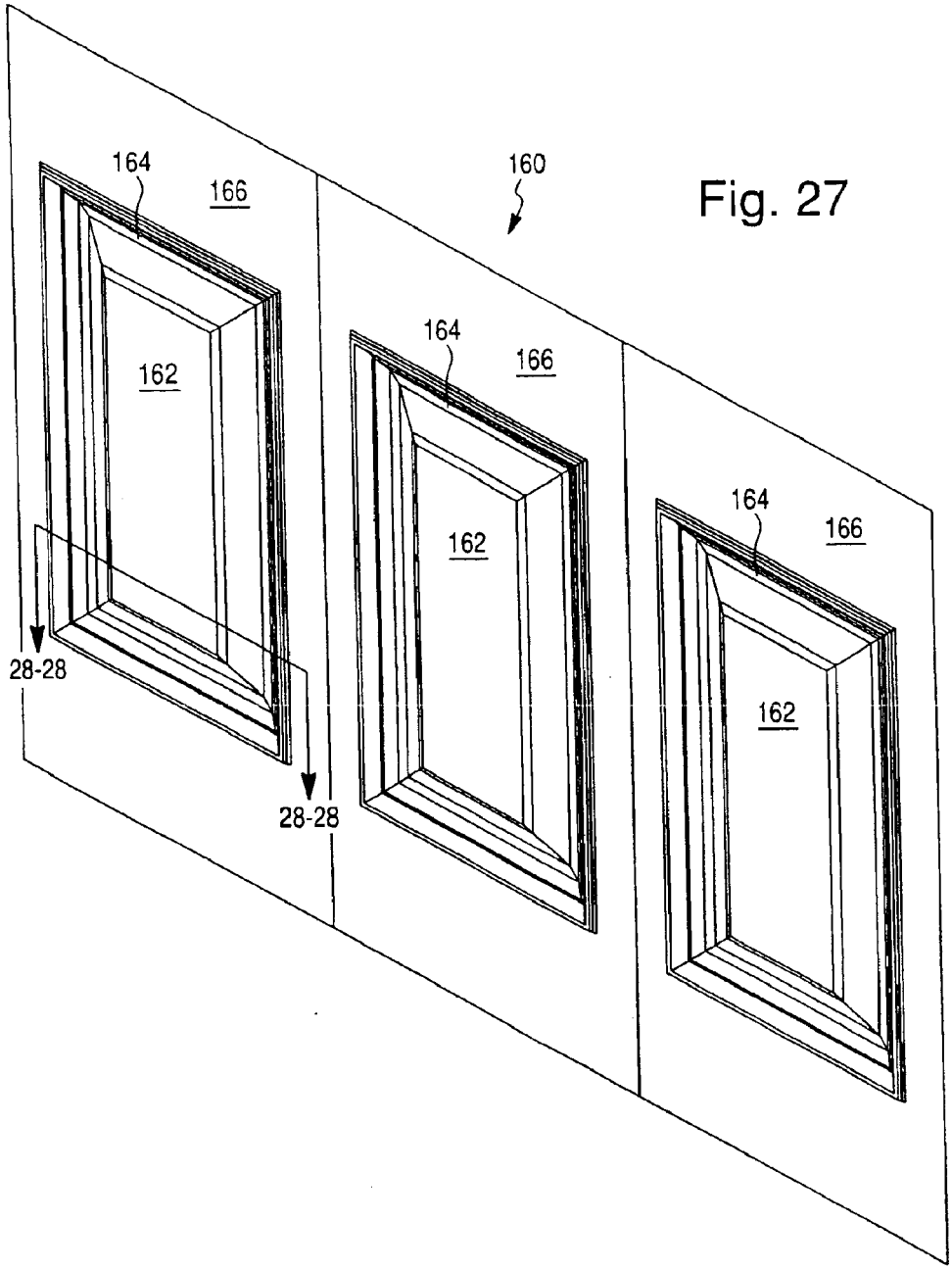
Fig. 27
Fig. 28
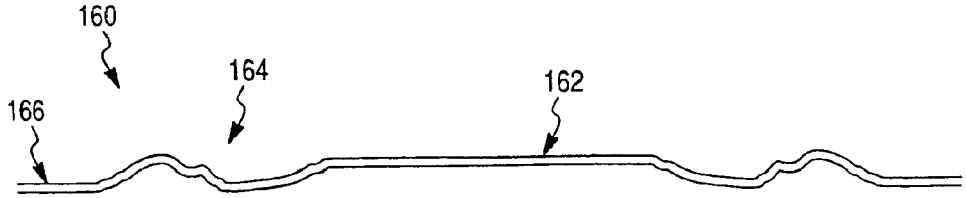

METHOD AND APPARATUS FOR CREATING AN IMAGE ON AN ARTICLE AND PRINTED ARTICLE

CROSS REFERENCE TO RELATED APPLICATIONS AND CLAIM TO PRIORITY

The present application claims the benefit under 35 U.S.C. §120 of U.S. Provisional Patent Application Ser. No. 60/369,798, filed Apr. 3, 2002, titled "Method and Apparatus for Printing an Object", the disclosure of which is hereby incorporated by reference.

FIELD OF THE INVENTION

The present invention is directed to a method of printing an image on an object, comprising the steps of: providing an object having an exterior surface having a planar portion and a channel recessed from the planar portion; applying a first ground coat on the exterior surface; drying the first ground coat; and spraying droplets of ink on the dried ground coat to form an image, wherein the droplets are sprayed from an ink jet printhead that is maintained at a constant distance from the plane of the planar portion of the object. The invention also relates to an object having an image created according to the disclosed method, and a printing apparatus for creating the printed object.

BACKGROUND OF THE INVENTION

Solid, natural wood is a relatively expensive material, and thus items made from natural wood are generally more expensive than items made from alternative materials such as plastic or wood composite. In addition, solid wood provides aesthetic qualities that are desirable to many consumers. As the price of natural wood has increased, the market for manufactured products that simulate natural wood has grown. For example, door skins, wainscot, molding, trim, and the like are often made from composite materials, such as fiberboard, rather than from solid wood.

Hollow core doors simulating natural, solid doors are well known in the art. Such doors are often formed from two thin sheets of fiberboard, referred to as "door skins", which are secured to opposite sides of a peripheral frame. The resulting door has the thickness of a solid wood door, but is hollow in the middle or has a solid core. The hollow space may be filled with corrugated pads, a contoured wood fiber core, insulation or another material if desired. The door skins may have a smooth, planar surface (i.e. flush door skins), a textured surface, or a contoured surface (i.e. molded door skins). Molded door skins are often formed to have portions simulating stiles, rails and panels, as found in traditional wooden rail and stile doors.

Wood composite articles, such as door skins, are somewhat similar to natural wood in strength and density, but lack the appearance of natural wood, especially the color, grain and/or inlay patterns that are considered desirable by many consumers. Therefore, such molded articles are often painted to enhance the appearance of the composite material used to form them. If a natural appearance is desired, a wood veneer may be bonded to the surface of the article. For example, boards used to make "flat-pack" furniture often comprise a core of chipboard, with a wood veneer secured to the exterior surface of the core to give the appearance of a solid, natural wood board. Such a board is often lighter and less expensive than a solid board of comparable dimensions, which may be advantageous depending on the application of the board.

The veneer may comprise a thin sheet, or plies, of solid wood. Alternatively, the veneer may be a plastic-based material on which an image of wood is applied. The veneer is bonded to the underlying core substrate either before or after the article is manufactured. Veneers are widely used as coatings to create simulated wood for tables, doors, and other furniture articles. Papers and foils may also be used to simulate the appearance of wood grain. However, the application of veneers, papers and foils is often time consuming, and, especially in the case of papers and foils, can produce an unacceptable product if great care is not taken in the application of the materials. This increases the manufacturing cost of such articles and results in varied aesthetics.

Another method of simulating a wood grain pattern provides for printing the wood grain pattern on the surface of a flat article using a patterned roller, known as offset-gravure printing, that transfers paint onto the article's surface. Alternatively, cylinders engraved with a desired wood grain pattern may be used. However, such printing methods are generally complex, and require the use of a different set of rollers or cylinders for each desired pattern or for differently shaped articles being printed. The rollers or cylinders produce doors having identical patterns with small repeats due to cylinder size. In addition, the engraved cylinders and rollers are relatively expensive, but not overly reliable to hold close register.

In an attempt to provide more varied patterns without the use of multiple rollers or cylinders, some methods provide for the use of jets of fluid to create random wood-grain-like patterns on flat panels of various materials. For example, one such method is disclosed in U.S. Pat. No. 4,849,768. Other methods including printing on flat fiberboard using an ink jet printhead, such as disclosed in U.S. Pat. No. 5,683,753 and U.S. Pat. No. 6,095,628.

However, prior art ink jet printing methods have failed to achieve satisfactory image quality on a printed article, particularly when printing on fiberboard. While it may sometimes be possible to produce low-resolution simulated wood grain on planar surfaces, such as flush door skins, it has heretofore not been possible to produce high-quality images directly on contoured surfaces. Instead, when high quality images are needed, it is necessary to print such images on paper or film and then attach the paper or film to the surface of the substrate in a labor-intensive lamination step. Thus, for example, doors having high quality images are generally made in limited quantities, when the cost can be justified. Moreover, on contoured surfaces, such as molded door skins, it has not heretofore been possible to produce either a realistic wood grain or other images in the recessed and/or raised contoured portions of the skin.

It is known from prior art patents such as U.S. Pat. No. 6,360,656 to Kubo that a surface having a raised feature can be ink jet printed if the ink application rate is varied as a print head passes over the feature. However, this method requires that the distance between the printhead and the raised feature be carefully controlled, and therefore sensors are required to accurately measure the distance between a printhead and the surface being printed. If the feature is a recessed portion, such as a molded channel, additional problems arise using the method disclosed by Kubo. First, the width of the channel may be less than the width of the printhead, making it impossible to lower the printhead into the channel to maintain the required spacing between the printhead and the surface being printed. Second, turbulence surrounding ejected droplets of ink may be magnified by the narrow channel, making it difficult to control the placement of ink droplets.

Increasing the distance between the printhead and recessed portions of a surface to be printed, to overcome problems associated with Kubo, have also failed to achieve a adequate quality image. One of the problems of increasing the distance of travel of the ink droplets in the region of a recess is that after a short distance of travel from the printhead nozzles, there is breaking of the droplets due to the viscosity of the air and the relatively small size of the droplets. As the droplets lose momentum, they become increasingly susceptible to air currents that move the droplets away from their intended path. This ultimately leads to errors in droplet placement and thus reduction in image quality. Furthermore, even if the distance between the printhead and surface to be printed is relatively short, a first droplet that is emitted from a nozzle sometimes interacts with the subsequent droplet emitted from the same and/or adjacent nozzle because the subsequent droplet moves in the slipstream of the first droplet and thus speeds up relative to the first droplet. These effects are magnified in confined areas such as within a recessed portion. This affects droplet placement and image quality.

If a curtain of ink droplets is deposited, as for a multi nozzle printhead, the droplets often slow down because their momentum is transferred to the air. This effect can act as an "air pump," causing the droplets at the edge of the curtain to be pulled in towards the other droplets, causing turbulence and droplet interaction. Droplet placement and image quality may be adversely affected. Furthermore, if the article to be printed is moving relative to the printhead, there may be additional detrimental effects on droplet placement. All of these effects combine to reduce print quality.

It is therefore desirable to provide a method of printing either wood grain images or other graphic images on the surface of a flush or molded article, such as a door skin, in a manner that produces high quality images over the entire exterior surface being printed.

SUMMARY OF THE INVENTION

The present invention is related to a method of printing an image on an article, such as a wood grain pattern on a door skin, an apparatus for printing, and the resulting printed article. The invention is also related to an image processing apparatus for creating an image to be printed. The method and apparatus may be utilized to create various decorative products, such as millwork, molding, plant-on panels, closet or wardrobe doors, molded wainscot, decorative cabinet doors, and exterior polymeric doors. The method may also be used to enhance natural wood and veneer faced surfaces.

The images are printed on the article using an ink jet printer, which provides great flexibility in what can be printed. Different products, for example those with a short product life for which the making of a specific print roller might not have been justified, can now easily be printed using the disclosed ink jet technique. Customized objects, such as simulated wood species and decorative graphic images, can be produced quickly and cheaply. Printing a wood grain pattern onto an article using an ink jet printer has been found to give a good result easily and relatively cheaply compared with the use of a wood or simulated wood veneer. As used herein, the term "wood grain" includes any pattern resembling a feature of wood grain, preferably of any type of wood.

The disclosed method may be used to print on a part of a surface of an article. For example, a simulated wood region may form only a part of an object, for example a frame of a framed picture. Ink jet printing provides the flexibility to print in register on small areas of an object.

A method of printing an image on an object is disclosed, comprising the steps of: providing an object having an exterior surface having a planar portion and a channel recessed from the planar portion; applying a first ground coat on the exterior surface; drying the first ground coat; and spraying droplets of ink on the dried ground coat to form an image, wherein the droplets are sprayed from an ink jet printhead that is maintained at a constant distance from the plane of the planar portion of the object.

A method of applying an image to a door comprises the steps of: selecting an image to apply to a door; determining the dominant color of the selected image; selecting a color related to the dominant color; applying a primary ground coat of the selected color to the door; and ink-jet printing the selected image on the primary ground coat.

A method of applying an image to an object having a planar portion and at least one channel comprises the steps of: selecting an image to apply to an object; determining the dominant color of the selected image; selecting a first color related to the dominant color; applying a primary ground coat having a color to the object, the primary ground coat color being of the selected first color; applying a secondary ground coat having a second color to the channel; and ink-jet printing the selected image on the object over at least a portion of the planar portion and at least a portion of the channel.

A method of forming a predetermined pattern on a door skin comprises the steps of: providing a molded door skin having a planar portion and a channel portion; providing an ink-jet printhead supported for movement in a plane parallel to the planar portion; and printing a pattern on the planar portion and the channel portion while moving the printhead in the plane.

A method of applying a photographic quality ink jet image to a wood composite door having a planar portion and a channel comprises the steps of: selecting an image to apply to a door from among a plurality of images; determining the dominant color of the selected image; selecting a color related to the dominant color; applying a primary ground coat of the selected color to the door; applying a secondary ground coat having a color darker than the primary ground coat to the channel; providing an ink jet printhead mounted for movement between first and second positions in a plane parallel to the planar portion of the door; moving the printhead from the first position to the second position while ejecting ink droplets having a diameter greater than about 30 $\mu$m toward the door to form a first portion of photographic quality image on the door; moving the door away from the printhead; moving the printhead from the second position to the first position; moving the door toward the door to a new position with relation to the printhead; moving the printhead from the first position to the second position while ejecting ink droplets having a diameter greater than about 30 $\mu$m toward the door to form a second portion of a photographic quality image on the door; allowing the ink droplets to dry; and applying a UV resistant topcoat over the ink.

A molded object comprises an exterior surface having a planar portion and a channel formed in the planar portion. A primary ground coat of pigment covers the exterior surface, and a photographic quality ink-jet printed image overlays the primary ground coat. A topcoat covers the ground coat and the image.

A method of forming a door comprises the steps of: providing a rectangular frame; providing a first door skin having a planar portion and a channel molded in the planar portion; providing a second door skin; attaching the first and second door skins to the rectangular frame; coating the first and second door skins with a sealant; spraying droplets of ink against the first door skin to form a photographic quality color image on the first door skin, the image overlaying at least a portion of the planar portion and a portion of the channel; and applying a topcoat over the color image.

An apparatus for printing a photographic quality ink jet printed image on a molded object comprises a coating device for applying a primary ground coat to an upper face of an object. The upper face has a planar portion and a recessed channel. The apparatus also includes an ink jet printer for printing an image on the upper face, the printer comprising an ink jet printhead for emitting ink jet ink droplets. The printhead is moveable on a plane parallel to the plane of the planar portion.

BRIEF DESCRIPTION OF THE FIGURES

The invention extends to methods and/or apparatus substantially as described with reference to the accompanying drawings.

FIG. 27 is a perspective view of wainscot suitable for being printed according to the disclosed printing method;

FIG. 28 is a fragmentary cross-sectional view taken along line 28—28 of FIG. 27 and viewed in the direction of the arrows;

DETAILED DESCRIPTION OF THE INVENTION

The present invention is directed to a method and apparatus for creating an image on an article, such as a simulated wood grain pattern on a door skin, using an ink jet printer. Any object that can be printed using ink jet printing is suitable for the disclosed invention. Preferably, the printed object includes hard rigid surfaces, although other surfaces such as wood veneer or paper overlaid wood composites, are also suitable.

The printed object preferably comprises a three-dimensional object, such as one or more of furniture, a fixture and/or a fitting, and/or a fixed construction. The surface of such an object preferably includes at least one recess and/or projection. Prior attempts to print on uneven surfaces using an ink jet technique achieved unacceptable results due to the variation in distance of the substrate from the printhead. However, the disclosed printing technique achieves images having surprisingly high quality.

Examples of suitable objects to be printed include exterior and interior passage doors, furniture and cabinet doors, closet and bifold doors, door frames and moldings, widow frames, furniture components, tables, picture frames, molded wall paneling, wainscot and other such objects.

Figure 1:
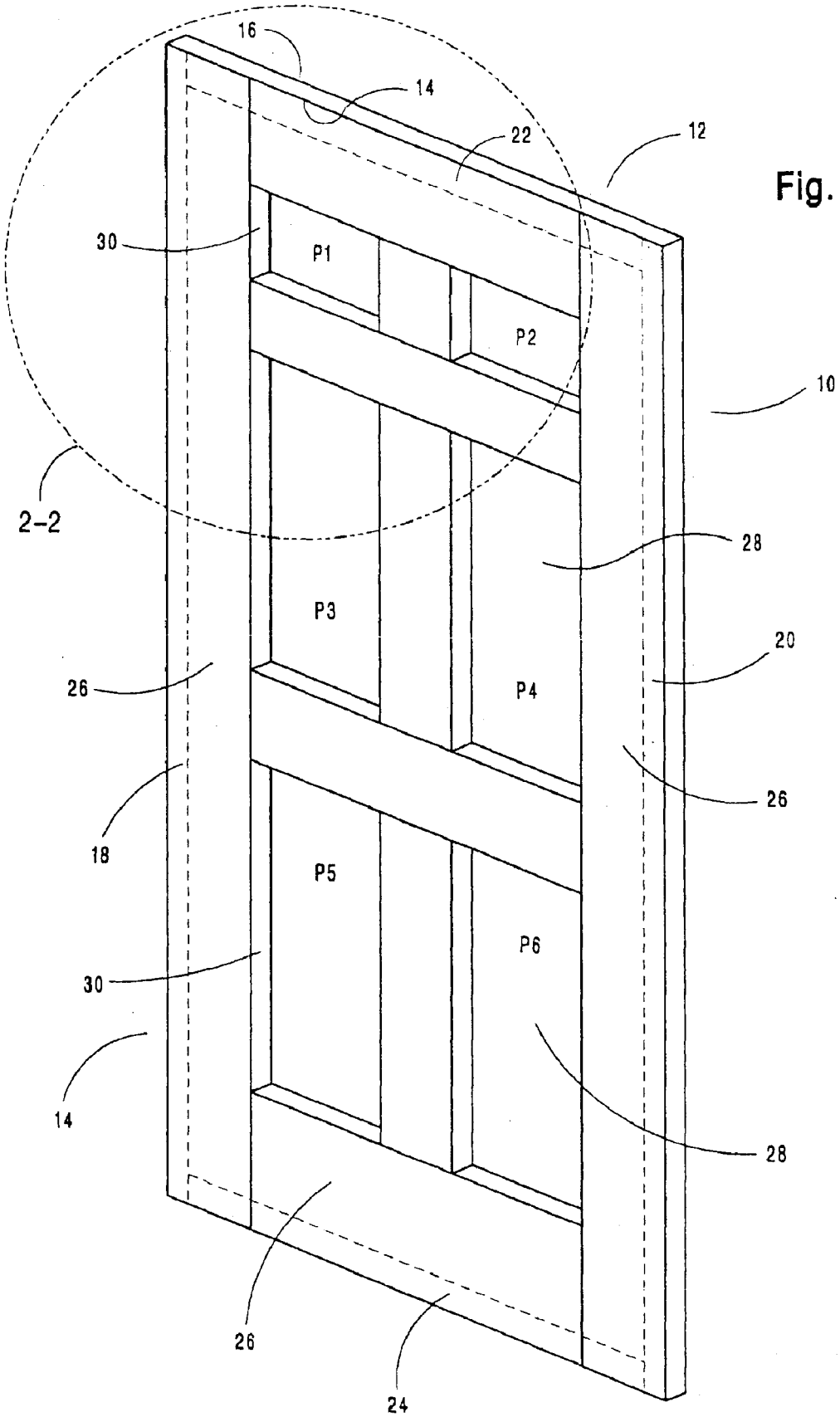
FIG. 1 is a perspective view of a door to be printed according to the present invention.

A door and/or door skin is particularly preferred for application of the disclosed printing method. For purposes of explanation, the present invention will be explained with referenced to a door 10 that is to be printed, as best shown in FIG. 1. However, it should be understood that other objects are suitable for printing, as noted above.

Door 10 comprises a peripheral frame 12, and a first and second door skin 14, 16 secured to opposing sides of frame 12. (Note that only an edge of skin 16 is shown in FIG. 1). Frame 12 includes opposing stiles 18, 20 and rails 22, 24. Door 10 is preferably a hollow core door, as well known in the art. Skins 14, 16 are preferably molded from a composite wood material, such as medium density fiberboard (MDF) or high density hardboard, but other substrates such as polymeric door faces, natural wood or plywood, post-molded wood composites, and doors with special film or paper overlay surfaces may be used. Furthermore, skins 14, 16 may be molded using any known method, such as wet-dry press molding, dry press molding, or post-forming. Each of skins 14, 16 includes an exterior surface and an interior surface for securing to frame 12 using adhesive to form door 10. As known in the art, door 10 may also include additional support members and/or door core materials disposed between skins 14, 16.

Figure 2:
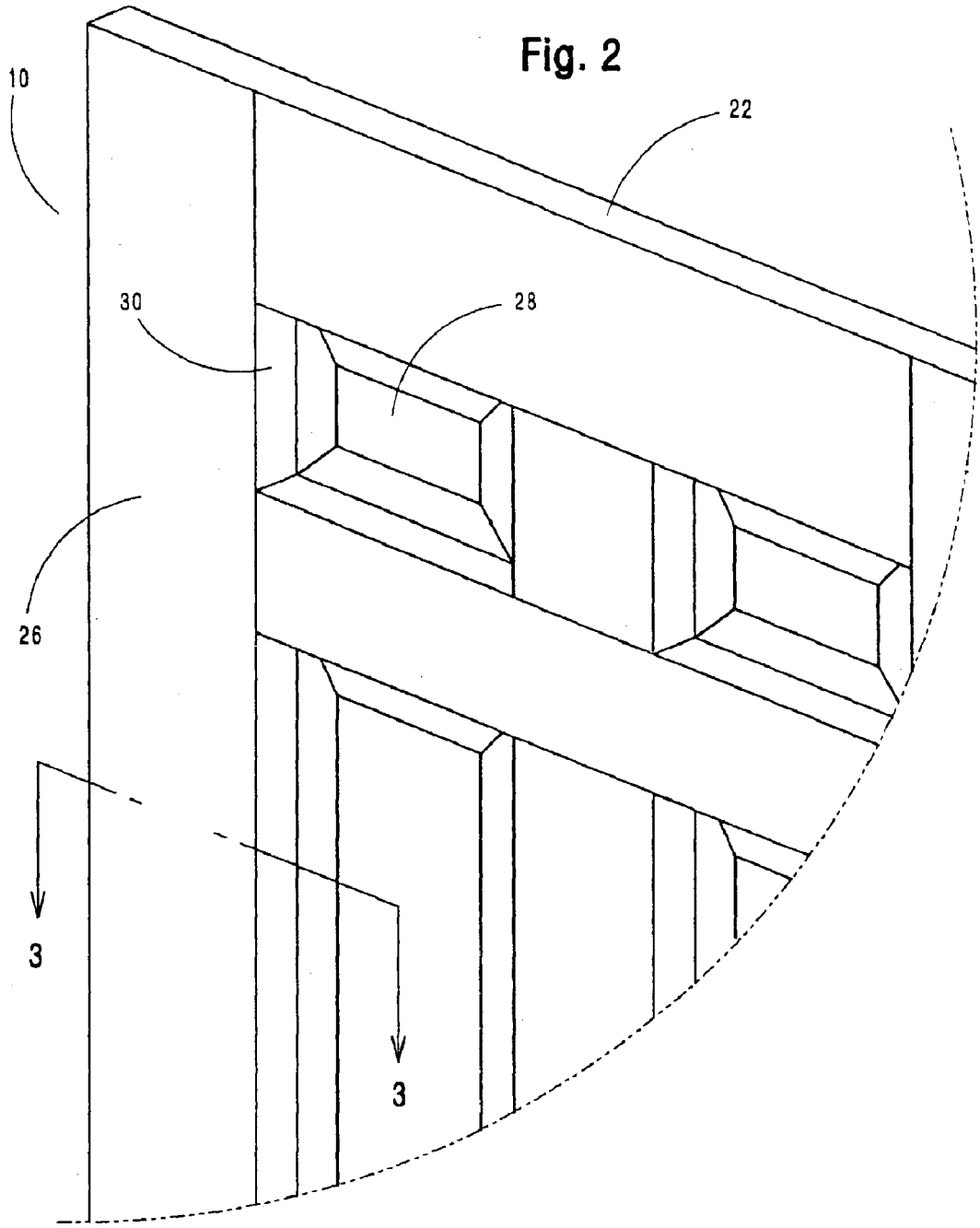
FIG. 2 is a fragmentary exploded view of circled area 2—2 of FIG. 1.
Figure 3:
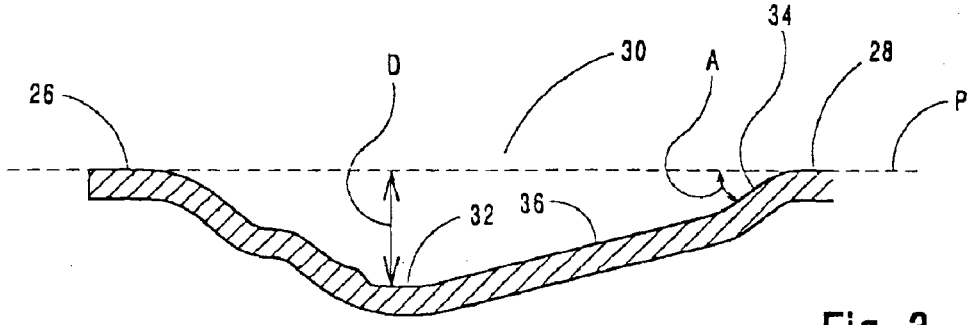
FIG. 3 is a cross-sectional fragmentary view of the door of FIG. 2 viewed at line 3—3 in the direction of the arrows.

Door skins 14, 16 include major planar portions 26 and simulated panels 28 surrounded by channels 30. Channels 30 are recessed from the plane P of planar portions 26, as best shown in FIGS. 2 and 3. As best shown in FIG. 3, each channel 30 has a depth D, defined as the separation between the plane P of planar portion 26 and a bottom 32 of channel 30. Depth D is preferably between about 1 mm and about 11 mm. Each channel 30 may also include sloped sidewalls 34 extending downwardly at an angle A towards bottom 32 relative to the plane of panel portions 28 (which is preferably coplanar with plane P, as shown in FIG. 3). Preferably, sloped sidewalls 34 extend downwardly at an angle A of 80 degrees or less relative to plane P of planar portion 28. Sloped sidewalls 34 preferably include a flat portion 36; however portions of sloped sidewalls 34 may also be contoured. Channels 30 define simulated panels 28, as in a natural, solid wood door. Fore example, door 10 includes channels 30 simulating panels P1, P2, P3, P4, P5 and P6.

Figure 4:
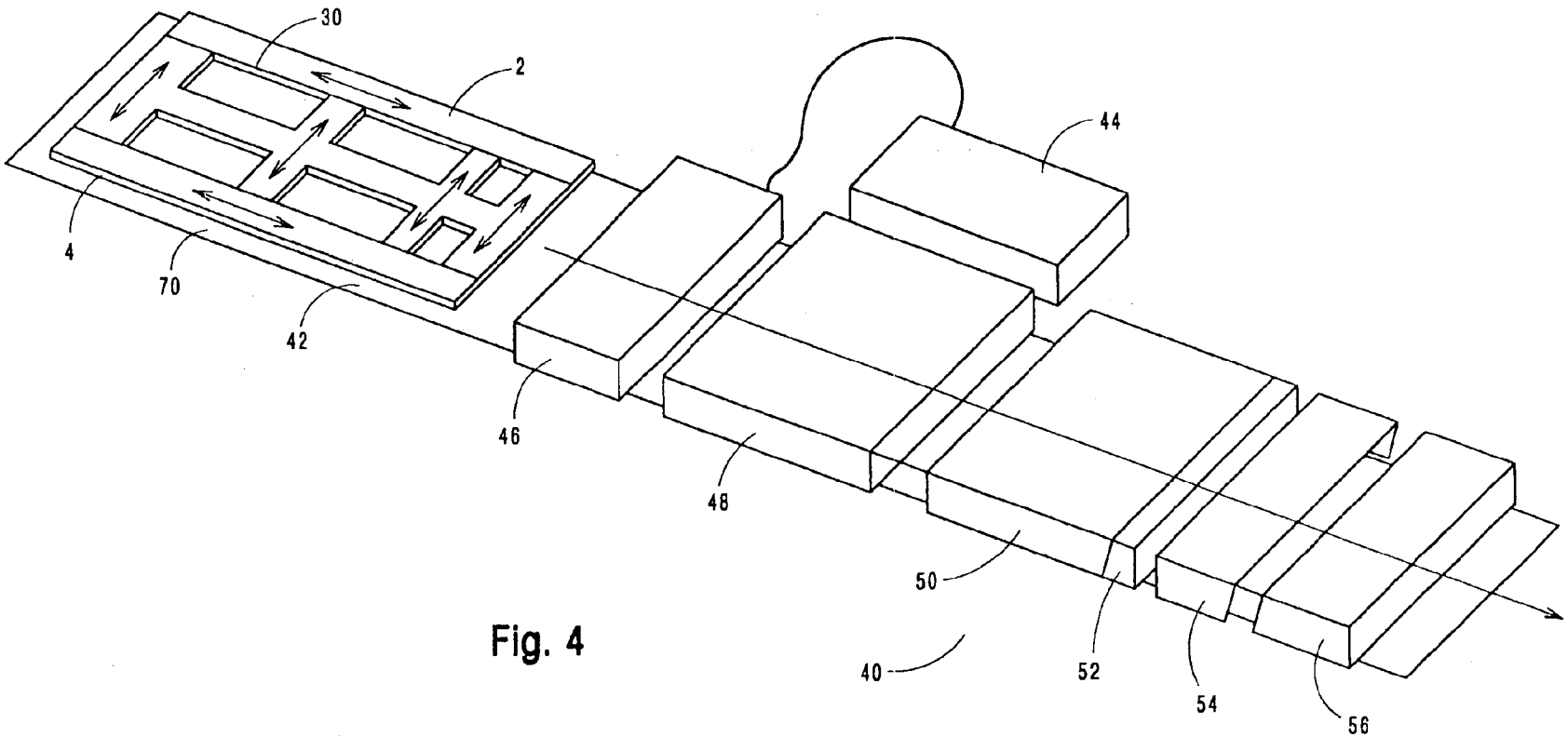
FIG. 4 is a schematic view of a printing apparatus according to the present invention.

As best shown in FIG. 4, a printing apparatus 40 is provided for printing an image on an object, such as door 10. Apparatus 40 preferably includes a bed 42 for supporting door 10. Preferably, bed 42 can support a plurality of objects to be printed. Bed 42 may also include a means for arranging objects on bed 42, such as a loading tray. However, the arrangement and positioning of the objects to be printed may also be carried out manually.

Preferably, door 10 includes sealed wood composite door skins (14, 16). After providing door 10, an image to be printed on an upper face 2 of door 10 is selected. A plurality of images may be stored in a memory of a controller 44, such as a personal computer (PC). Controller 44 may include a library of images or prints, which can be applied sequentially, resulting in a more realistic effect. Next, the dominant color of the selected image is selected, either by controller 44 or manually by a user. The dominant color is the color or tone in the selected image that is most prevalent in the image when viewing the image in its totality. A color related to the determined dominant color is determined. The color related to the dominant color is generally a shade of the dominant color. (For example, tan is a color related to a dominant color of a darker brown). The color related to the dominant color will therefore enhance the appearance of the selected image when the selected image is printed over a groundcoat of the related color.

Preferably, the positioning of upper face 2 to be printed is registered with controller 44 by identifying the location and positioning of door 10 on bed 42. In this way, controller 44 advantageously knows where the object to be printed (i.e. door 10) is and can then adjust the position of the image to be printed accordingly. This can be done, for example, by locating a feature on door 10, such as the location of a channel 30, or some other descriptive feature on the object as a registration point. An object may include more than one registration point, such as several channels 30. It will be appreciated that registration is of particular importance where the image has been manipulated so that the printed image corresponds to particular features of the object. For example, the image may be manipulated so that a greater density or darker color is printed in channels 30. Features of the object, such as an embossed grain pattern on the surface of the object, or stiles or rails of a door, may act as registration points affecting the print image.

Apparatus 40 also preferably comprises a means for applying a ground coat to upper face 2 of door 10, such as a spray coating device 46, prior to ink jet printing door 10. A ground coat of paint of the related color is applied to upper surface 2 of door 10 by spray coating device 46. This can provide a uniform bright surface and can also provide color, which can minimize the amount of ink used on a darker image. For example, this coating may comprise a mahogany colored paint that is applied to upper face 2, which is positioned uppermost and faces spray coating device 46. Various methods of applying the related color to upper face 2 may be employed by spray coating device 46, such as by manual spray gun or by robotic sprays. Preferably, the coating of the related color is applied to upper face 2, as well as the opposing face on door 10 (i.e. the exteriorly disposed faces of skins 14 and 16). In addition, side edges 4 of door 10 may also be coated with the related color.

The ground coat is preferably applied to door 10 by a method other than ink jet printing, since ink jet ink is relatively expensive. In addition, this primary ground coat may be the background color and/or tone for a particular image to be printed. For example, if a wood grain pattern is being printed, the ground coat may be the background tone of the woodgrain pattern. The use of paint or other non-ink jet ink for the background tone may be appropriate if a "dark wood" is to be printed onto a light colored surface. Otherwise, a relatively large amount of ink jet ink must be used for the entire image, thereby increasing manufacturing costs. It is therefore preferred that the ink jet ink be used for printing only the wood grain tick patterns and background tone of the grain when minimizing manufacturing costs. As used herein, wood grain tick patterns are a series of corresponding lines simulating wood ticks as found in natural wood, and may include width, coloration and density variations.

The ground coat preferably has a high surface tension in the range of 38–50 surface dynes and should be applied in a smooth coat without dry spray to maximize ink droplet formation. If the ground coat is not formulated for a smooth application, micro-cracks may form on surface of the skin, resulting in a foggy or non-continuous final print. Spread of the ink droplets on the surface of the ground coat is also important. Good absorption of the ink results in a more continuous print with more brilliant color definition. A preferred ground coat is a thermal plastic formulation supplied by Valspar of High Point, N.C.

Alternatively, ink jet ink may be used to enhance or modify the color of the ground coat applied by coating device 46. However, a ground coat should be selected having a color that is similar to that of the desired background tone, so that the amount of ink jet ink used is again minimized. Using differing ground coat colors, it is possible to simulate different types of wood using the same wood grain image. It should be noted that if desired, the entire image to be printed may be done using ink jet printing technique, thereby eliminating the necessity for coating device 46.

A second ground coat may also be applied, particular when the object to be printed includes one or more channels 30, such as with door 10. The secondary ground coat is applied onto channels 30. Preferably, this secondary ground coat is also a color related to the dominant color of the selected image, but is generally a darker shade compared to the primary ground coat. In this way, the secondary ground coat provides a suggestion of shadowing in channels 30 of upper face 2 and masks any slight decrease in print quality that may occur on the irregular surfaces of channels 30. The darker ground coat tone provides a richer appearance compared to printing on a lighter toned ground coat, and reduces the amount of ink jet ink needed.

In addition, there is a tendency for the print density to decrease in contoured portions, such as channels 30. Controller 44 aligns the object to be printed by registering particular features of the object, and then applies a print grid to the object, which determines the placement of the ground coat pigments and ink jet ink. The print grid is a two dimensional construct used by controller 44. However, the object to be printed is three dimensional. As such, when the print grid overlays the object, contoured portions may not be adequately accounted for with respect to print density of ink and/or pigment needed. Specifically, the surface area of contoured portions of the object may not be accurately accounted for, causing "stretching" of the print grid which gives an apparent lower density of ink required for printing the image. However, a substantially constant density of the printed image is preferred in order to achieve a high image quality. If a regular printing frequency were used for recessed portions, the print density in such recesses might be less than elsewhere on the surface. The density can be made constant by, for example, increasing the density of ink to be printed in channels 30 (or on a projection) by changing the color of the ink printed in channels 30 and/or adjusting the image to be printed, for example by adjusting the print grid.

The secondary ground coat compensates for such reduced print density and/or lessens the visual impact of any imperfections in the image by darkening channels 30. Therefore, the secondary ground coat preferably has a color that is darker than the primary ground coat color. The secondary ground coat may be non-ink jet ink, such as paint or stain, which is cheaper than ink jet ink, and may be applied by spraying or a robotic device.

The first and second ground coats are then cured or dried at a drying station 48. Drying station 48 may comprise an induction radiation heater for drying the ground coat, or some other pigment drying device known in the art.

Door 10 is then forwarded to a printing station 50 (described in detail below) and the selected image is ink jet printed on upper face 2. Preferably, the ink jet ink is UV-curable ink, for example Sericol UviJet curing ink. The UV-curable ink is then cured using a UV curing lamp 52, which is preferably incorporated into printing station 50.

A UV curable topcoat or protective layer may then be applied to upper face 2 of door 10 at a topcoat station 54. The topcoat may be, for example, a clear varnish. Topcoat station 54 includes a device for applying the protective topcoat onto door 10, such as by spraying, thereby covering the printed image on upper face 2. The topcoat is then dried at a UV topcoat curing station 56 using conventional curing techniques, dependent on the topcoat formulation. The topcoat protects the printed image from, for example, mechanical damage and may also improve color fastness of the printed product. In addition, it has been found that, although substantially clear, the UV protective topcoat unifies the various elements of the printed image and masks any graininess produced by the individual droplets of ink jet ink.

Door 10 may then be turned over to expose the face opposite upper face 2 (the exteriorly disposed face of skin 16). The coating and printing steps may then be repeated by passing door 10 through the same apparatus 40, or by using a different apparatus. It will be appreciated that different methods could be used to provide the initial and/or final coating steps described above. For example, the coating or uniform color for printing could be provided using a toned groundcoat or overlay, in which case the preferred coating is a water-based paint. Alternatively, the primary ground coat may be applied to all exteriorly disposed surfaces of door 10 by dipping door 10, as known in the art. It should be noted that the opposing sides of door 10 may be coating and printed to have identical patterns, or they may be different.

Figure 5:
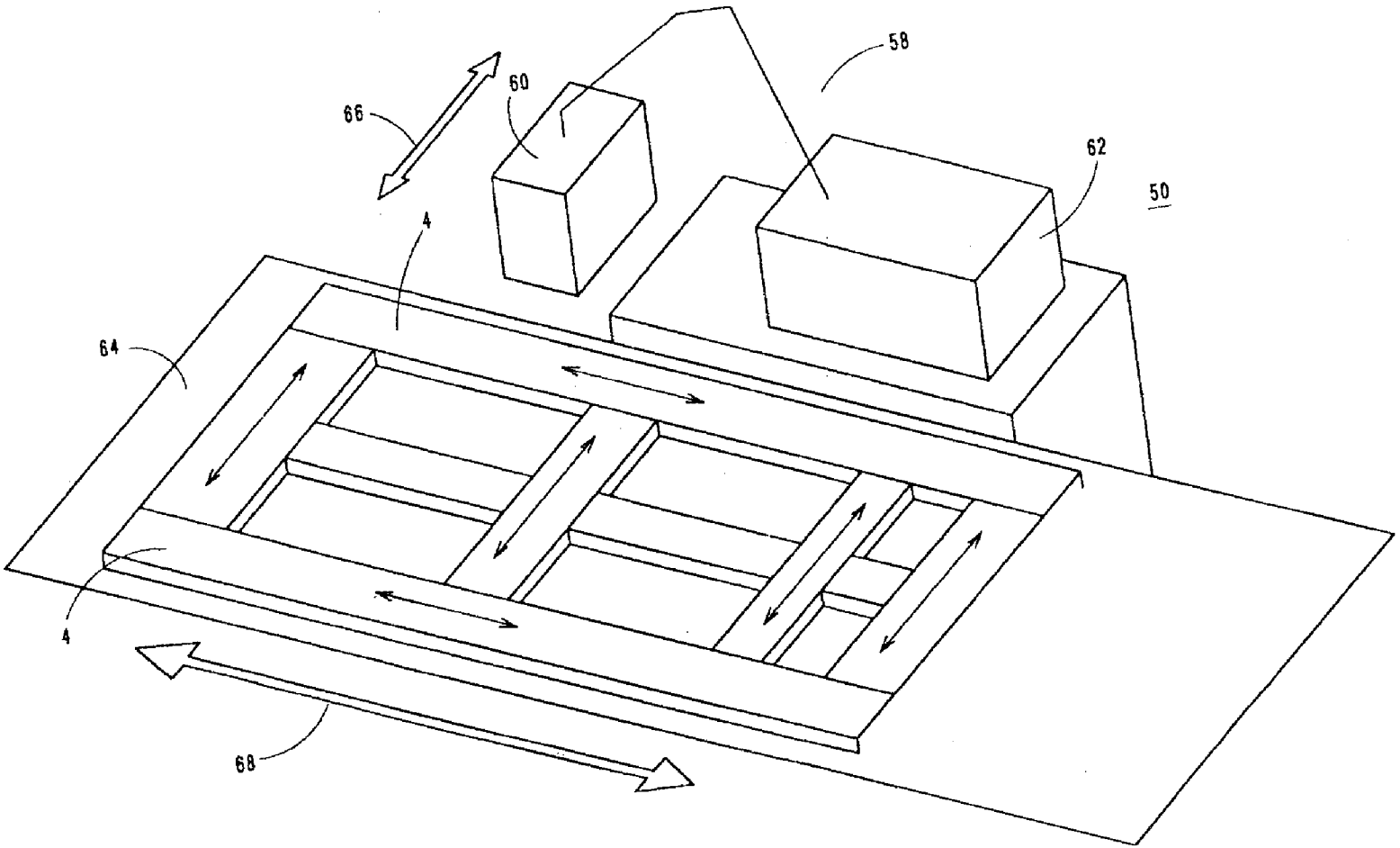
FIG. 5 is a schematic view of a printing station according to the present invention.

Printing station 50 will now be described in detail. As best shown in FIG. 5, printing station 50 includes a printer 58. Printer 58 has at least one ink jet printhead 60, which is connected to a print control device 62, and a printer bed 64. Printer bed 64 may be operably associated with bed 42 of printing apparatus 40, or bed 42 may be integrated with printer 58. Print control device 62 includes an image processor for creating the image. For example, the image processor may create an image based on a photo of a wood grain pattern input into print control device 62. Each image might be created from scratch for each type and size of object. Typically for a door, the individual rails, stiles and panels will be made using different photo images and pasted together on graphics software by print control device 62. Then, color density manipulations and adjustments may be made if needed, so that the image accurately simulates wood grain and compensates for any shallow angles of printing.

Where a particular image is to be printed in a channel or projection of an object, the object should be in the correct position before printing. In some cases, it may be possible to position the object in exactly the same position every time in printer 58. However, apparatus 40 preferably includes a means for registering the position of the surface to be printed, such as with an optical device operably associated with printer control device 62. In this way, the image to be printed may be accurately aligned with a print grid used by printer control device 62. For example, the optical device may identify corners of door 10 or channels 30, and use the position information to align the image to be printed with the object within 1/64 inch. In this way, artwork may be tailored for each given object size, such as a particular door design or shape, by registering any molded features of the object, or even the embossed grain texture on a molded or a flush object.

Printhead 60 is mounted for movement in a direction perpendicular to the direction of movement of door 10. Arrow 66 shows direction of movement of printhead 60, and arrow 68 shows the direction of movement of bed 64 (or 42). In this way, printer bed 64 is moveable relative to printhead 60. Preferably, printer 58 is a flat bed printer, such as the Eagle 44 scanning moving bed ink jet printer of Inca Digital Printers Limited of Cambridge, United Kingdom. Door 10 may be arranged on printer bed 64, and printer bed 64 is able to move longitudinally backwards and forwards under printhead 60, which moves transversely (i.e. perpendicular to the direction of movement of printer bed 64). In this way, the whole width of door 10 may be effectively printed.

Figure 6:
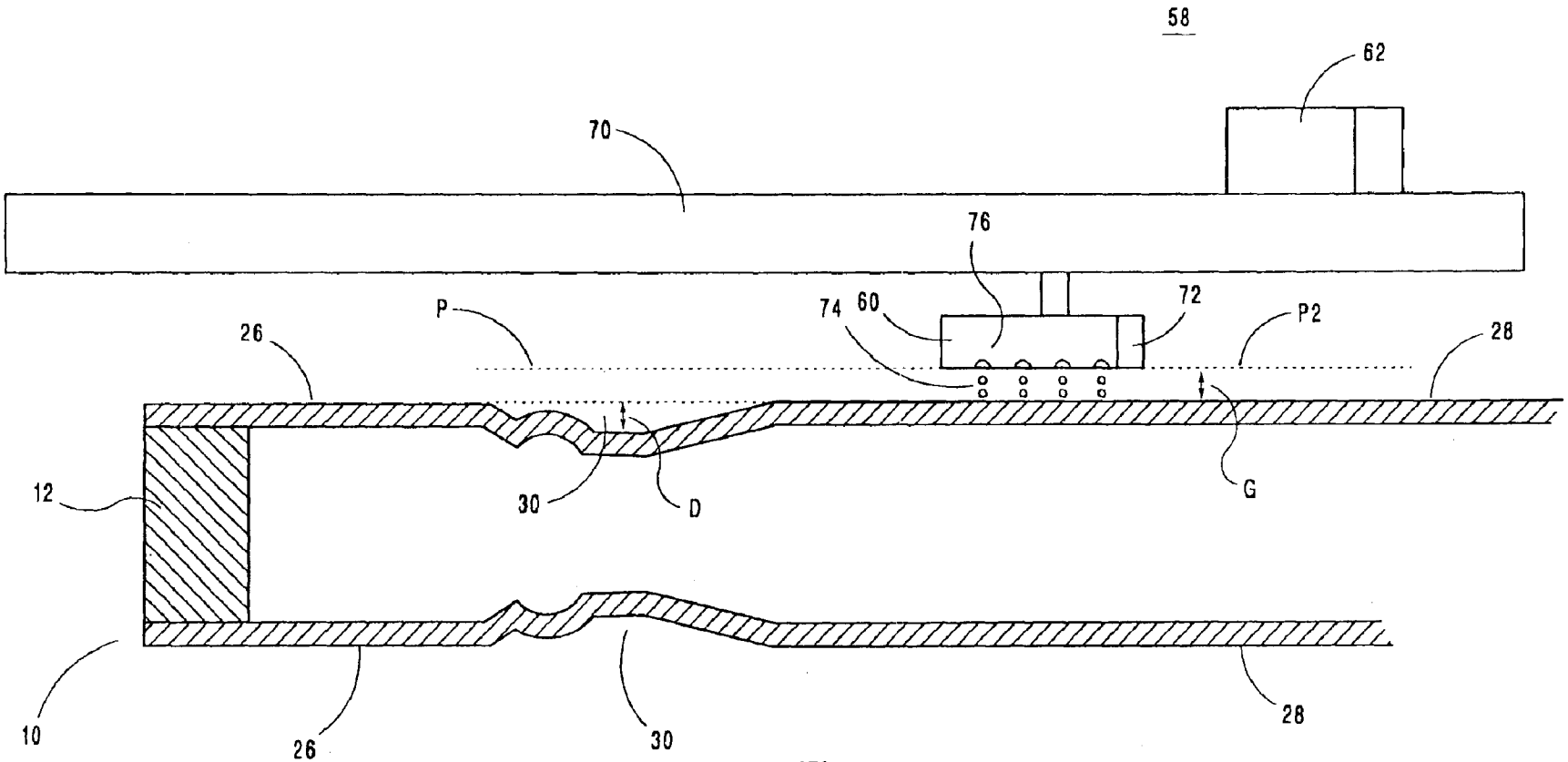
FIG. 6 is a schematic view of a printer applying ink to a door having a channel.

As best shown in FIG. 6, printer 58 may include a rail 70 for supporting printhead 60. Rail 70 provides for lateral movement of printhead 60 under the control of print control device 62, as described above. Print control device 62 is preferably controlled by controller 44 of apparatus 40. In this way, data stored in the memory of controller 44, including positioning information and image data, may be communicated to print control device 62. In addition, printhead 60 preferably includes a UV curing lamp 72 for drying and curing the ink jet ink. Alternatively, a separate curing station 52 may be provided. Ink jet ink droplets 74 are emitted from nozzles 76 on printhead 60.

The nozzle outlets of printhead 60 travel in a plane P2 that is separated from plane P of door 10 by a space G. Therefore, the distance traveled by ink droplets 74 emitted from nozzles 76 varies depending on whether printhead 60 is over a planar portion 26 (or panel portion 28) or over a channel 30. The maximum printing distance between nozzles 76 and upper surface 2 of door 10 is therefore equal to the depth D of a channel 30 plus space G (D+G=maximum printing distance). For example, if depth D is 12 mm, and gap G is 3 mm, the maximum printing distance will be about 15 mm.

The maximum printing distance is preferably less than about 25 mm, more preferably less than about 15 mm. Commercially acceptable images are obtained when the maximum printing distance is about 12 mm or less. It is envisaged that greater depths could be printed successfully by droplet size, space distance and depth manipulations, and therefore it should be understood that the present invention is not restricted with regard to the depth of the recess being printed. However, if the distance (D+G) is too great, applicants have found that the placement control of droplets 74 may become unacceptable in some cases, causing blurred images in channels 30.

Preferably, the object to be printed primarily includes recesses and few, preferably no, projections. The presence of projections can lead to large recessed areas which may result in poor ink coverage. Thus, it is preferred that nozzles 76 print a majority of upper face 2 at a closer distance (i.e. G as opposed to D+G). To compensate for any potential visual imperfections, the density of droplets 74 that are printed in channels 30 is preferably greater than elsewhere on face 2. In addition, increased printing density in recessed areas compensates for any "stretching" of the print grid, as explained above.

Channels 30 may be darkened by increasing printing density either before or after printing an initial image. A different density or color of droplets 74 may be applied to channels 30, such as by a spray application of a groundcoat or paint, a sprayed ground coat followed by a wiped or sprayed stain. Alternatively, the ovalo or recessed area may be rendered by building a darker tone into the registered ink jet artwork.

Nozzles 76 have a diameter of about 20 μm or more, preferably about 30 μm or more, more preferably about 40 μm or more. As such, droplets 74 will have a diameter approximately the same as the diameter of nozzles 76. For example, a Spectra NovaJet 256 printhead may be used, which creates droplets having a diameter of about 40 μm. By providing that droplets 74 are relatively large, for example having a diameter greater than 20 μm, preferably not less than 25 μm, preferably greater than 30 μm, more preferably greater than 40 μm, it has been found that the effects of the relatively long distance of travel of droplets 74 (i.e. space G as well G+D), are reduced and, surprisingly, accurate placement of droplets 74 is achieved, resulting in a high quality image. Preferably, the ink that forms droplets 74 is a pigment-based ink that is UV curable, and therefore is cured almost immediately after its application by UV source 72. Several inks suitable for this use are produced by Sericol, Inc. of Kansas City, Kans., under the brand name UviJet.

The movement of printhead 60 relative to upper face 2, and the shape of channels 30, are such that droplets 74 can be printed onto substantially the whole surface of channels 30, even if channels 30 are relatively deep (for example, 10 mm) and sloped sidewalls 34 and 36 are relatively steep (such as 75 degrees relative to plane P). This is achieved by adjusting the relative speed of printhead 60 and print bed 64, and by adjusting the angle of nozzles 76 relative to plane P2 (for example the nozzles could be tilted), and/or the angle upper face 2 of channels 30. This defines the incident angle at which droplet 74 is emitted from nozzle 76 relative to upper face 2. Preferably, a droplet 74 is emitted from nozzle 76 at an angle less than 20 degrees from perpendicular relative to printer bed 64.

The selected image is printed onto upper face 2 of door 10 in several longitudinal passes across the width of door 10 by printhead 60. In addition, each pass may include the use of more than one printhead 60 and/or more than one row of nozzles 76, so that each pass may effectively print in more than one set of print grid positions. Those skilled in the art recognize that nozzles 76 emit droplets of various desired colors in order to create the correct printed color.

Figure 7:
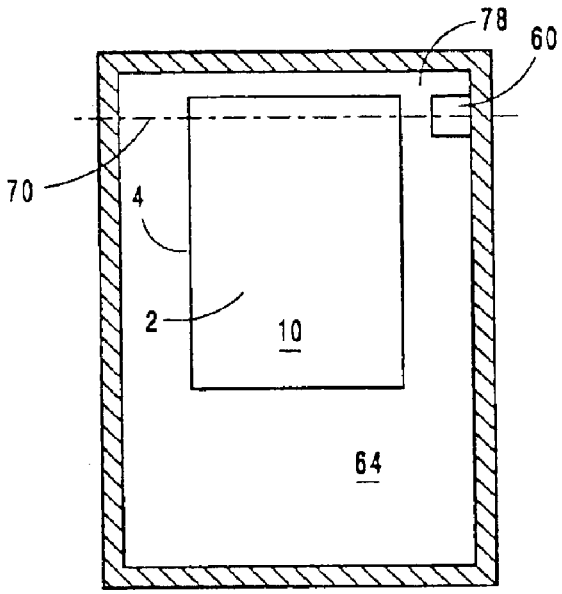
FIGS. 7–12 show schematically a method of ink jet printing a door according to the present invention.
Figure 8:
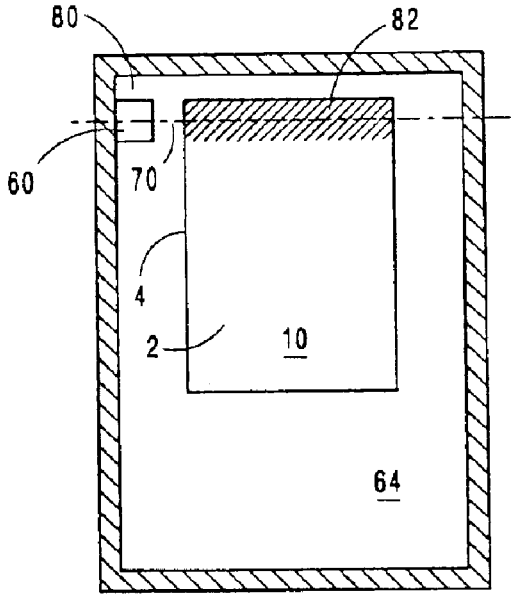

The relative movement and printing paths of printhead 60 relative to the surface being printed, door 10, is further explained with reference to FIGS. 6–12. Door 10 having upper face 2 and side edges 4 is supported on movable bed 64 of printer 58. Bed 64 moves under the control of print control device 62 with respect to rail 70 and printhead 60. Ink jet droplets 74 are applied to door 10 in strips running parallel to rail 70. Thus, to print an image that covers upper face 2, printhead 60 must pass multiple times across the width of door 10. FIG. 7 shows printhead 60 in a first position 78 adjacent door 10 and movable bed 64 holding an edge of door 10 beneath printhead 60, so that a first strip of an image can be applied to door 10 next to one edge thereof. FIG. 8 shows printhead 60 moved to a second position 80 and a first strip 82 of ink that has been applied to door 10. Printhead 60 includes a UV source 72 that illuminates ink applied to door 10. Thus, the ink of first strip 82 is cured almost immediately after it is applied to door 10.

Figure 9:
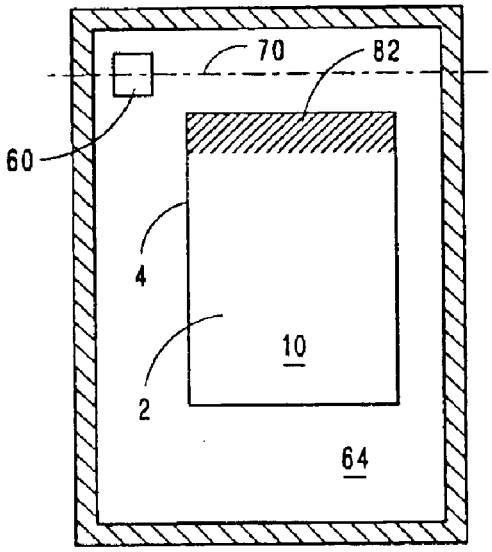
Figure 10:
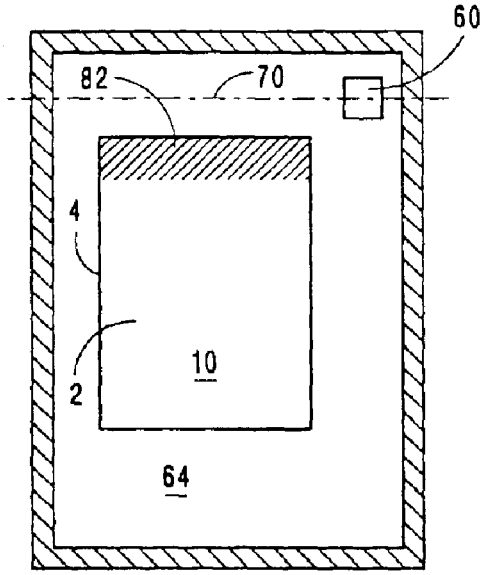
Figure 11:
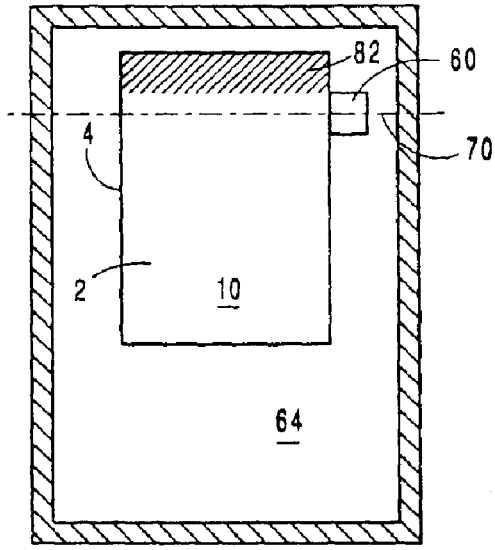
Figure 12:
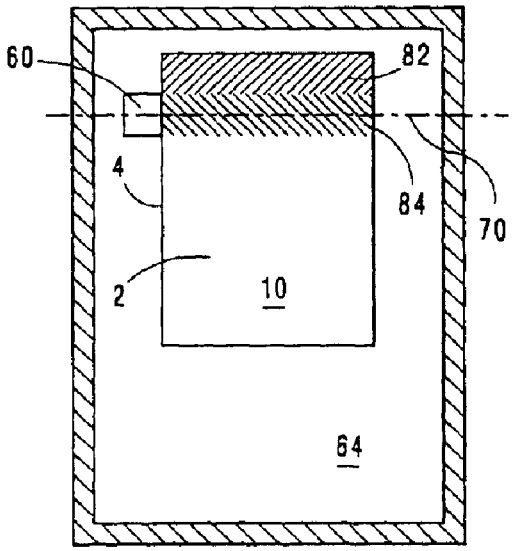

FIG. 9 shows door 10 moved away from printhead 60 and rail 70 so that printhead 60 can be rapidly moved from second position 80 to first position 78 as shown in FIG. 10, without danger of accidentally coming into contact with door 10. Printing in one direction also allows for curing of UV curable ink using a single UV source 72. FIG. 11 shows door 10 moved so that an unprinted portion thereof adjacent to first strip 82 underlines rail 70, and, as shown in FIG. 12, a second strip 84 of an image is ink-jet printed on door 10 adjacent first strip 82. These steps are repeated until the selected image has been completely formed on door 10. During all of the passes, printhead 60 is maintained at a constant distance from the plane P of planar portions 26 of door 10, even when printhead 60 is passing over channels 30.

A preferred drop velocity of droplets 74 is about 8 m/s and a typical velocity of bed 64 is 1.5 m/sec. As such, the perpendicular of a printed surface should preferably by no less than, for example, 20 degrees from the path of the incident droplet 74 relative to the surface being printed. This is sometimes particularly relevant for the small areas, for example, little chamfers and ledges at the edge of moldings. In some cases, it is possible to compensate for angle by increasing the density of droplets 74 printed in a given area according to the relative angle (typically density of print should be multiplied by a factor of 1/cos of the angle between the perpendicular to the surface and the path of the incident droplet relative to the surface). This can be done by standard color management techniques, but accurate registration may be needed. Preferably the surface is such that the angle between adjacent regions of the surfaces to be printed is not less than 90 degrees, preferably not less than 85 degrees, preferably not less than 80 degrees. For example, sloped sidewalls 34 preferably extend downwardly at an angle A of 80 degrees or less relative to plane P, as shown in FIG. 3. This ensures adequate ink coverage of all contoured portions, achieving a high quality image.

It is generally believed that smaller droplet sizes produce higher quality images. However, when printing on a wood composite substrate, especially a substrate having depressions, molded channels, or protrusions, it has been found that the opposite is true. As noted above, the placement of smaller droplets is often difficult due to air currents, slipstream effects, and air viscosity. However, relatively large droplets 74 have sufficient mass and momentum to remain relatively unaffected by such turbulence or other adverse effects. As such, the use of relatively large droplets 74 creates a high quality image, even on contoured surfaces such as upper face 2 of door 10.

Applicants have discovered that it is possible to obtain high quality print images, even photographic quality print images, by following the method of the present invention. (Note that "photographic quality" refers to very high quality images that closely resemble a photograph in image quality and color accuracy. Posters or reproductions of artwork, for example, are generally of photographic quality as this term is used herein. Prints that are blotchy or that include color inaccuracies or uneven edges are not included within this definition.)

In a preferred aspect of the invention, the disclosed method can be used to create a simulated wood grain pattern, even if the surface to be printed already comprises real wood. For example, the surface to be printed may comprise low quality plywood. By use of methods described herein, the plywood may be made to resemble a more expensive wood, such as cherry wood. This may be achieved, for example, by staining or painting the plywood with a "cherry" color ground coat. Then, a wood grain pattern is applied to the painted plywood, the pattern being typical of cherry wood. This has the added advantage that the plywood already has a wood texture that gives further perceived quality to the simulated "cherry wood".

When printing a wood grain pattern, preferably ink having color tones found in natural wood is used. This helps to reduce the amount of ink jet ink needed, and possibly the number of ink colors required, and therefore the number of printheads 60 required. Preferably a standard CMYK ink set is not used in the disclosed method.

Figure 13:
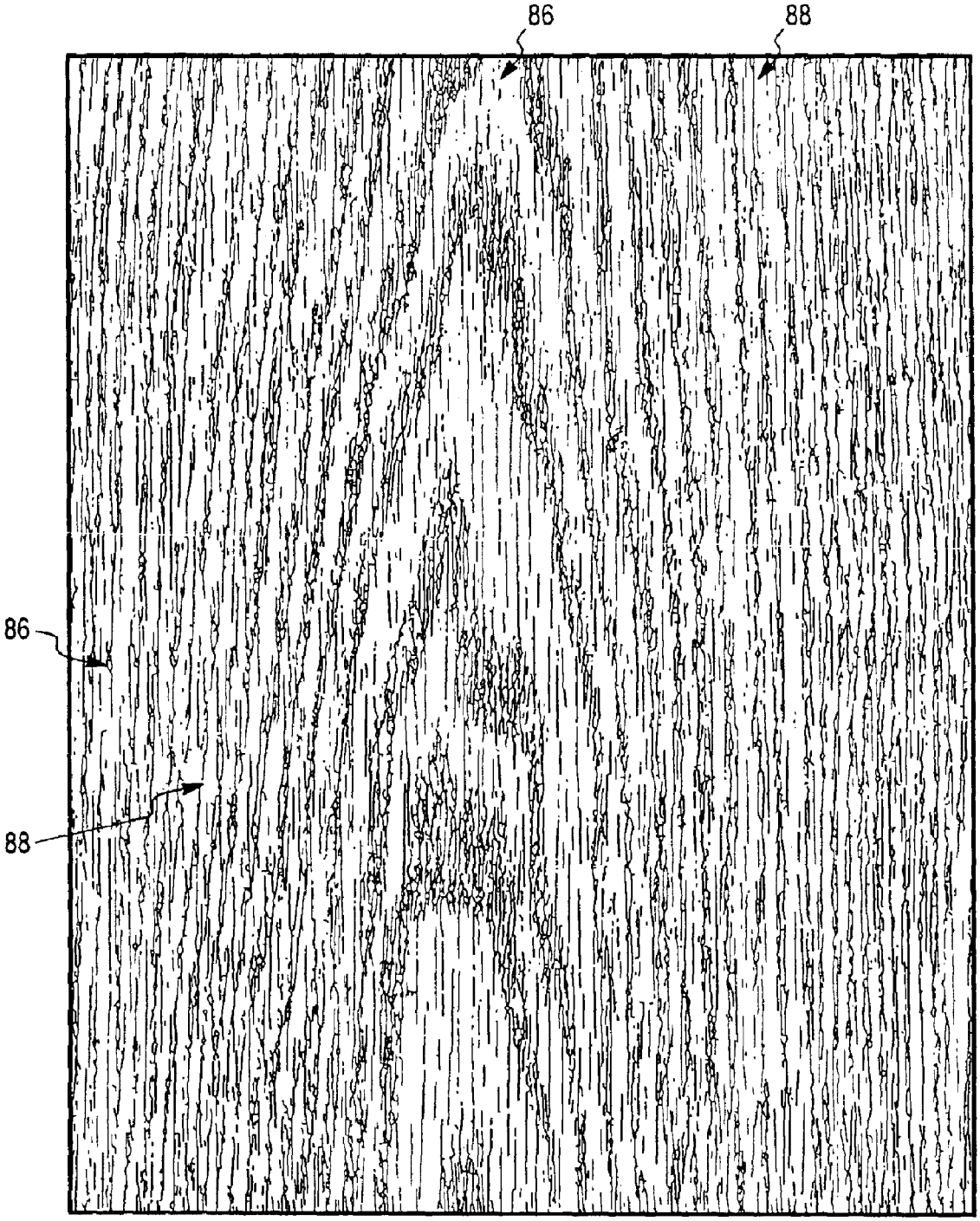
FIG. 13 shows a wood grain pattern printed using methods according to the present invention.

A representation of an example of a wood grain pattern is best shown in FIG. 13. The pattern includes detail of the heartwood and sapwood of a particular grain pattern. This image can be precisely duplicated based upon photographic images. Although the application of a ground coat prior to printing the wood grain pattern is sometimes preferred, it is not necessary. Ink jet printer 58 may print the background tones 86 of the wood grain image, as well as the darker lines and patterns simulating wood ticks 88. The application of a protective topcoat following ink jet printing may be utilized to control gloss and to provide long term performance.

Figure 14:
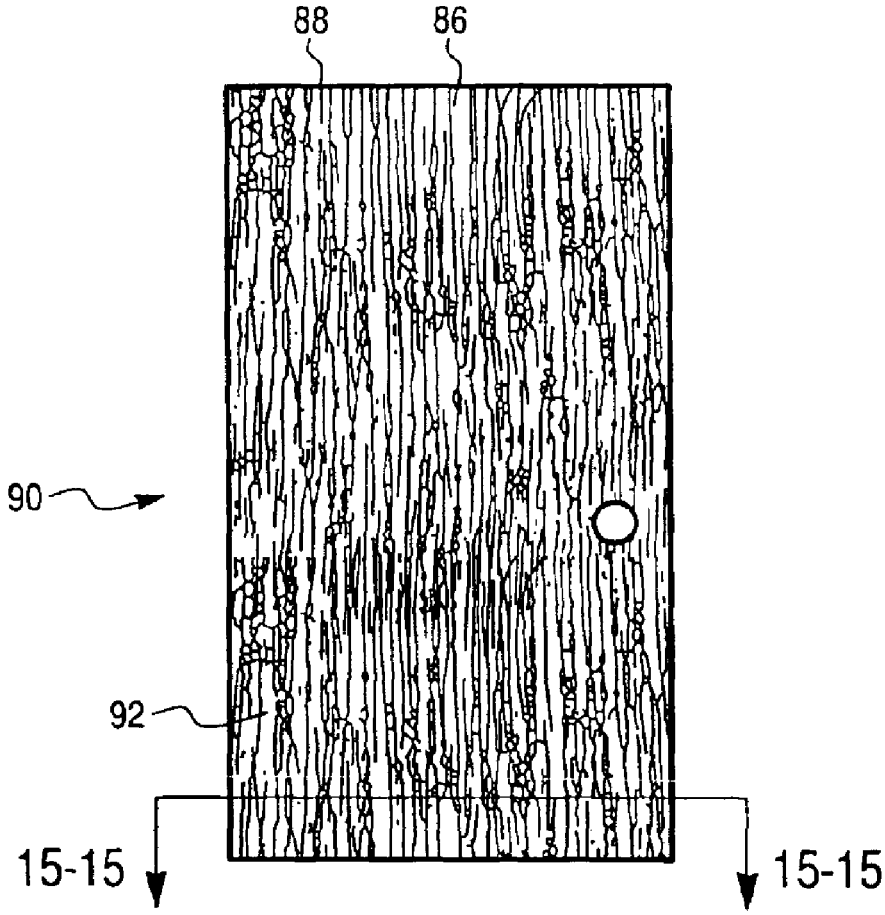
FIG. 14 is a front elevational view of a flush door skin having a wood grain pattern ink jet printed thereon by the method of the present invention.
Figure 15:
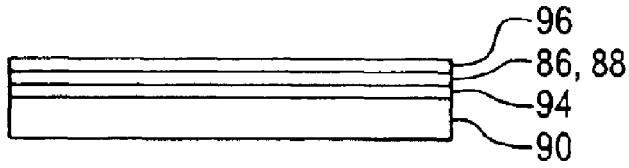
FIG. 15 is a sectional view taken through line 15—15 of FIG. 14 and viewed in the direction of the arrows.

A flush door 90 having a wood grain pattern printed on at least one face 92 of door 90 is best shown in FIGS. 14 and 15. The wood grain pattern includes background tone 86 and wood ticks 88. Using the method described above, a primary groundcoat 94 of paint, stain, or other pigment, having a color similar to background tone 86 is applied to face 92. Background tone 86 may then be further enhanced and colored by ink jet printing. In addition, wood ticks 88 are ink jet printed. A topcoat 96 may then be applied to door 10 following ink jet printing of background tone 86 and wood ticks 88. The resulting printed door 90 has a high quality, photographic image of a natural wood surface.

Alternately, to reduce the amount of expensive ink jet ink used in the printing process, a primary groundcoat 94 having a color corresponding to the color of background tone 86 may be used, thereby eliminating the necessity of additional coloration with ink jet printing for background tone 86. Only wood ticks 88 are thus printed using ink jet ink. Beneficially, this method reduces the amount of expensive ink jet ink needed, since less than half of face 92 needs to be coated with the ink jet ink. However, some of the fullness of the image obtained by inkjet printing both the background tone 86 and wood ticks 88 may be reduced.

Figure 16:
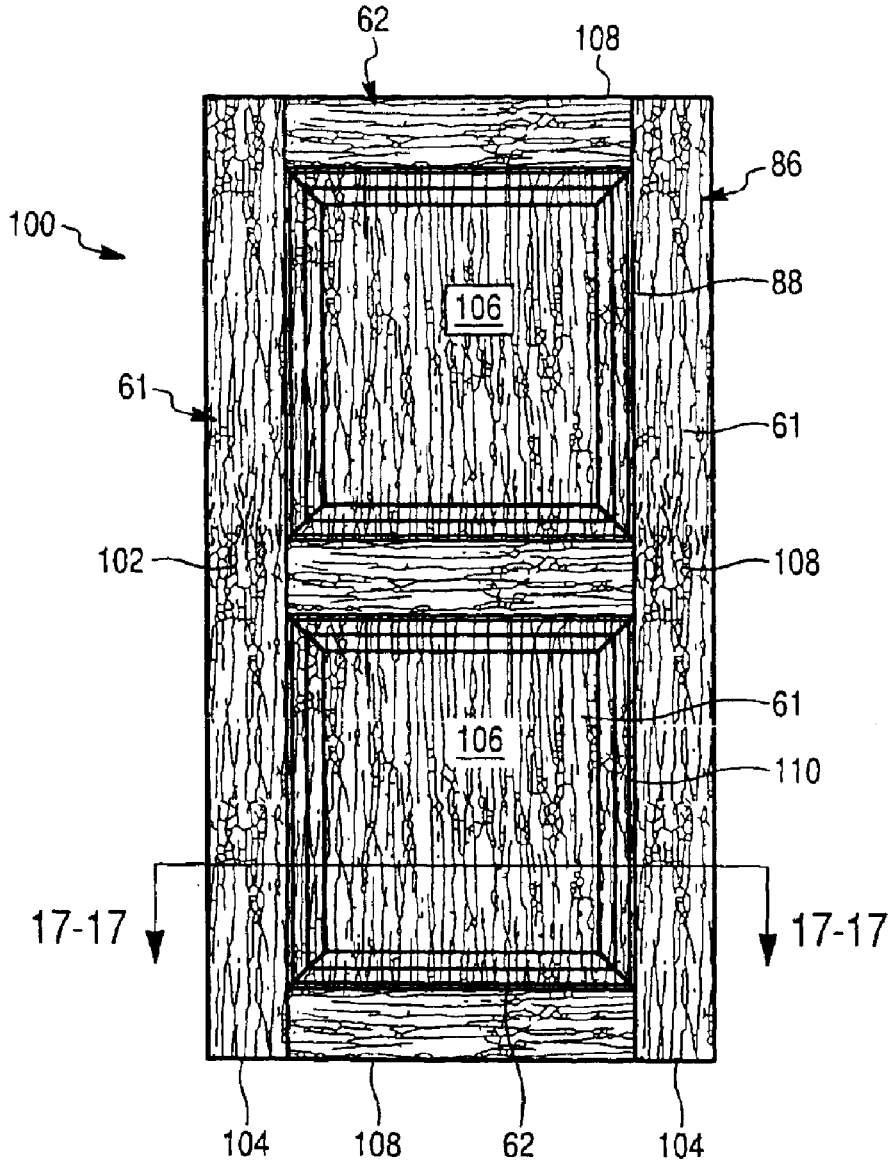
FIG. 16 is a front elevational view of a molded door skin having a wood grain pattern ink jet printed thereon with grain runs in two directions.
Figure 17:
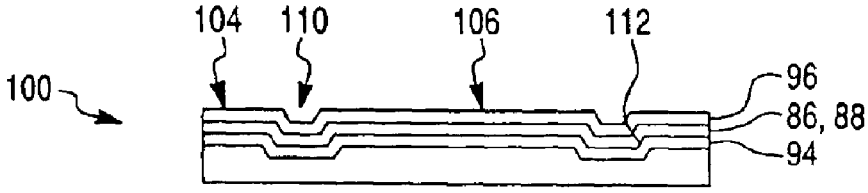
FIG. 17 is a sectional view taken through line 17—17 of FIG. 16 and viewed in the direction of the arrows.

Traditional rail and stile doors are formed with wooden elements each having wood grain running in the longitudinal direction of the element. Some of these elements are positioned at right angles to one another when a door is assembled, and, therefore, traditional doors may have wood grain running in two mutually orthogonal directions. As best shown in FIGS. 16 and 17, door 100 includes a wood grain pattern printed on at least one contoured face 102, and has the appearance of wood grain running in two directions to simulate the appearance of such traditional doors. As with door 90, door 100 includes background tone 86 and wood ticks 88. However, background tone 86 and wood ticks 88 are printed so that a first wood grain pattern G1 runs in a first direction on vertical stile portions 104 and panel portions 106, and a second wood grain pattern G2 runs in a second direction on horizontal rail portions 108. Because the stored image of wood grain pattern has wood grain running in two directions, this pattern can be printed in register to the design features of the molded door design or embossed textured pattern. The wood grain pattern may also be printed in channels 110 surrounding panel portions 106 in a direction corresponding to adjacent stile and rail portions 104, 108. Similar to door 90, face 102 of door 100 includes primary ground coat 94. Preferably, a darker secondary ground coat 112 is applied to channels 110 covering primary ground coat 94. Background tones 86 and wood ticks 88 are then printed using ink jet printing techniques, followed by an application of topcoat 96. The result is a high quality image over the entire surface of contoured face 102 of door 100.

Figure 18:
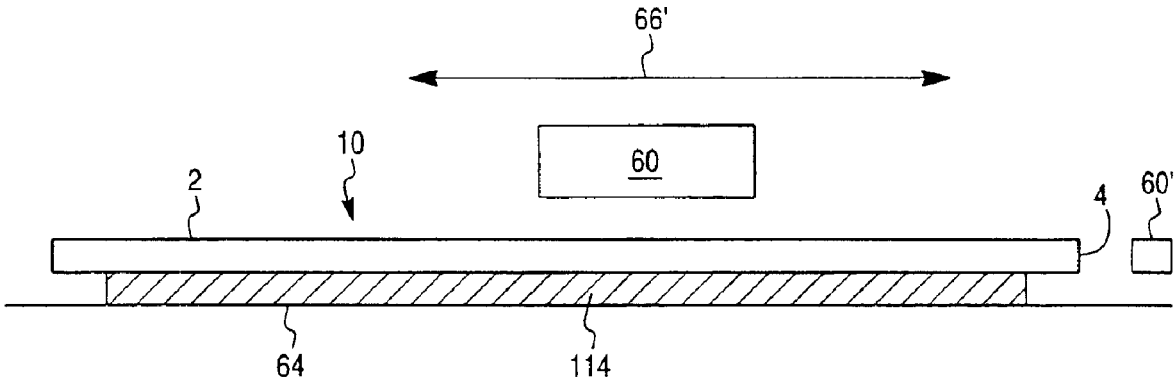
FIG. 18 is a schematic view of another arrangement of a printing station.
Figure 19:
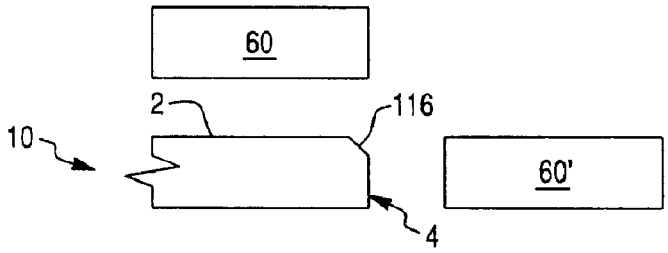
FIG. 19 is a schematic view of the printing arrangement of FIG. 18 with a door having a chamfer.

In some cases it will be sufficient for just the front and back faces of a door, such as exteriorly disposed surfaces of skins 14, 16, to be printed with a wood grain pattern. However, side edges 4 of door 10 may also be provided with the wood grain pattern. FIG. 18 shows an end view of an alternative printing arrangement, which may be used to print simultaneously upper face 2 and one side edge 4 of door 10. Door 10 is mounted on printer bed 64. A spacer 114 is provided under door 10 to space door 10 from bed 64. This reduces the amount of ink deposited on bed 64. A first printhead 60 prints onto upper face 2 as described above, moving in a direction shown by arrow 66'. A second printhead 60', as best shown in FIG. 19, is mounted at an angle of about 90 degrees relative to first printhead 60 and is arranged so that one side edge 4 of door 10 is simultaneously printed. It is preferable to register the two prints together on the same motion system. Thus, edges 4 may be coated to match the printed upper face 2 of door 10.

Preferably, second printhead 60' is also an ink jet printhead, for example a Spectra NovaJet 256 printhead. However, a method other than ink jet printing could be used to apply the wood grain pattern to side edge 4, for example by contact printing using a roller. Alternatively, a veneer could be applied to side edges 4. A further alternative could be a complimentary solid color paint, which could be applied to the edge of door 10 and then stain applied to render a wood-like appearance. Lighter colors of upper face 2 might require different treatment of side edges 4 compared to darker printed images. It is also possible that the printed image on side edges 4 be similar but not exactly printed to match the grain pattern of upper face 2.

In a preferred embodiment, the corner of door 10, where upper face 2 meets side edge 4, includes a chamfer 116, as best shown in FIG. 19. The presence of chamfer 116 gives a better finish to door 10. The first printhead 60, when located adjacent side edge 4, extends slightly beyond upper face 2 and therefore prints onto at least a part of the chamfer 116. Similarly, second printhead 60' extends beyond the end of side edge 4 and prints onto at least a part of the chamfer 116. Some part of chamfer 116 may therefore be printed by both printheads 60 and 60'. This achieves high image and print quality of portions of upper face 2 adjacent edges 4.

Figure 20:
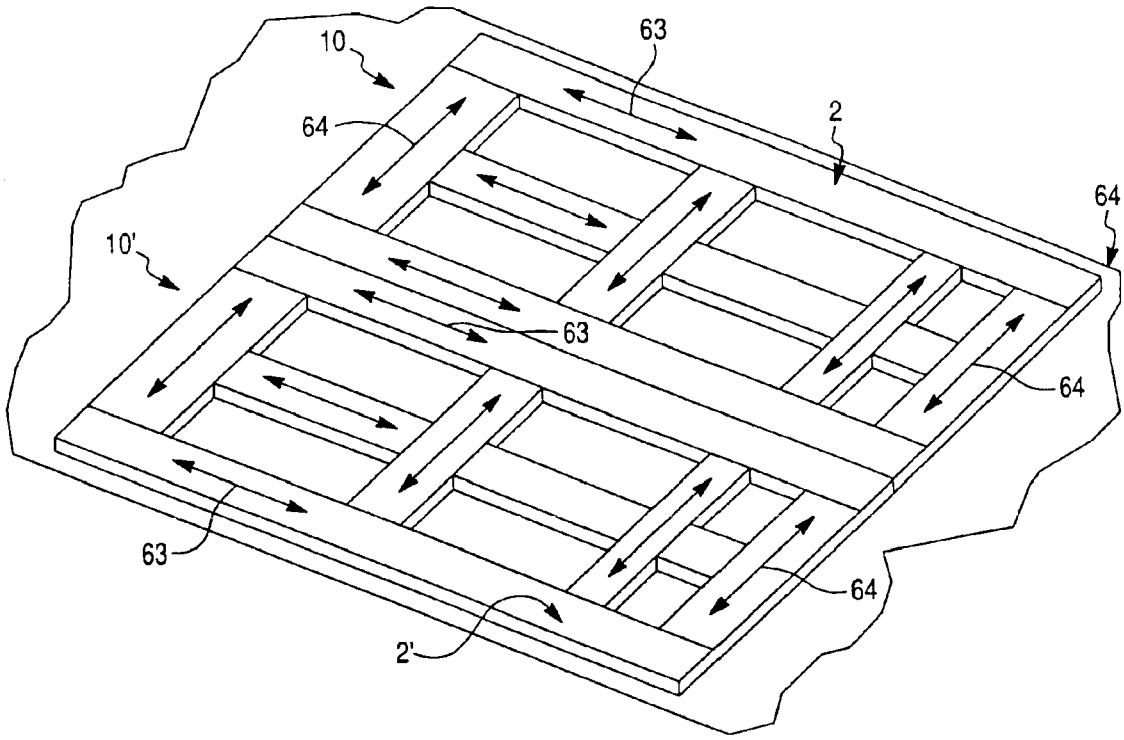
FIG. 20 is a schematic view of another printing arrangement for printing two doors simultaneously.

FIG. 20 illustrates a printing system for printing two doors 10 and 10' at the same time. The doors are placed side by side on bed 64. One or more printheads 60 may be provided to print the upper faces 2 and 2' of doors 10 and 10', respectively. In addition, a printhead may be provided for printing side edges of each door, as described above. As shown by arrows G3 and G4, a wood grain pattern may be printed in a first and second direction. Ink jet printing permits precise placement of ink droplets 74, and therefore the printing of wood grain in directions G3 and G4 may be accomplished as the printheads pass over the combined width of both doors 10, 10' (just as described for door 10 in FIGS. 7–12). Once the printing operation for upper faces 2, 2' is complete, doors 10 and 10' may be flipped to expose the unprinted faces, which may then be printed in a similar manner. A preferred ink jet ink used for this printing arrangement is Sericol UviJet UV curing ink.

Figure 21:
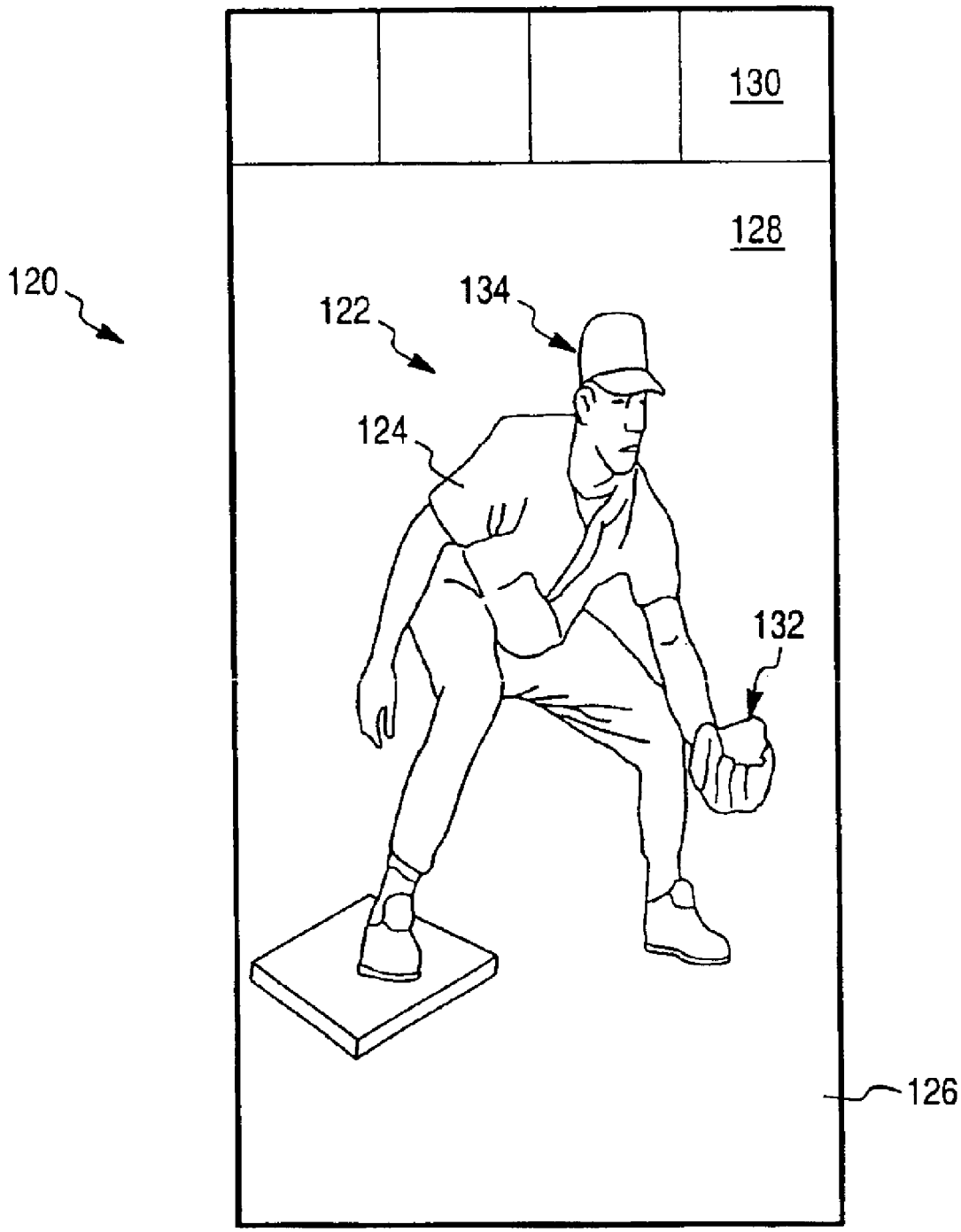
FIG. 21 is a front elevational view of a door having a graphic image printed thereon using the method of the present invention.
Figure 22:
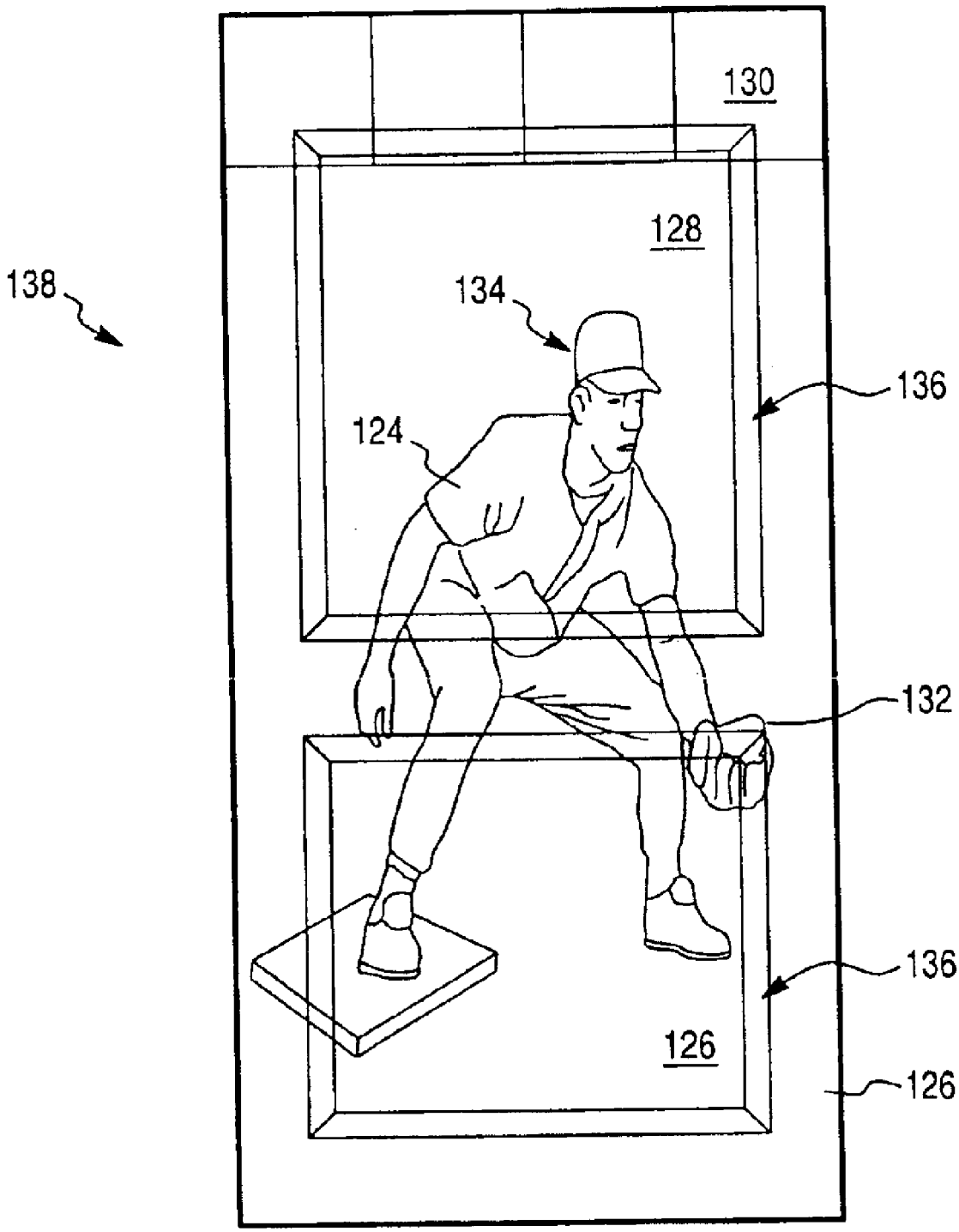
FIG. 22 is a front elevational view of a molded door having the graphic image of FIG. 21 printed thereon.

As best shown in FIG. 21, any image may be printed on an object, including a multi-color photographic quality image. For example, a door 120 may be printed to include a graphic image. The image comprises a baseball player 122 wearing an off-white uniform 124 standing on a light brown dirt infield 126 adjacent a green outfield 128 bounded by a dark green wall 130. Player 122 has a brown glove 132 and a red cap 134. In this example, the dominant color of the graphic image is light brown. This color covers approximately half of the door 120, and is compatible with the greens of the outfield 128 and wall 130. Therefore, a light brown primary ground coat is preferably applied to door 120 before the image is printed thereon to bring out the colors of the image. The image may overlap molded recessed areas 136 of a door 138 without reducing image quality, as best shown in FIG. 22.

Figure 23:
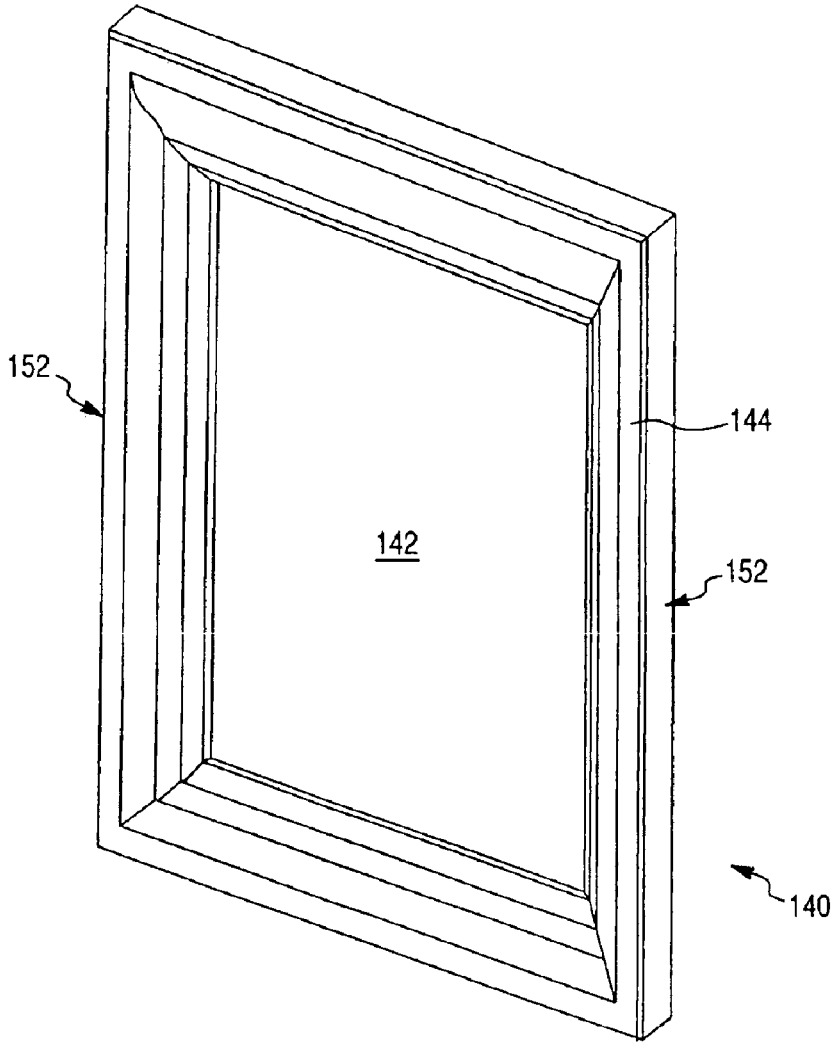
FIG. 23 is a perspective view of a molded casing to be printed according to the present invention.
Figure 24:
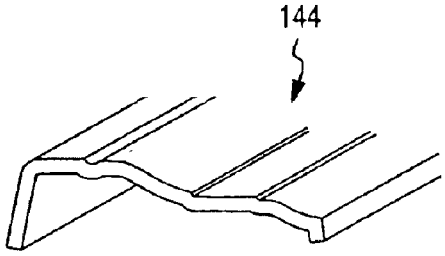
FIG. 24 is a fragmentary perspective view of an outer frame of the molded casing of FIG. 23.
Figure 25:
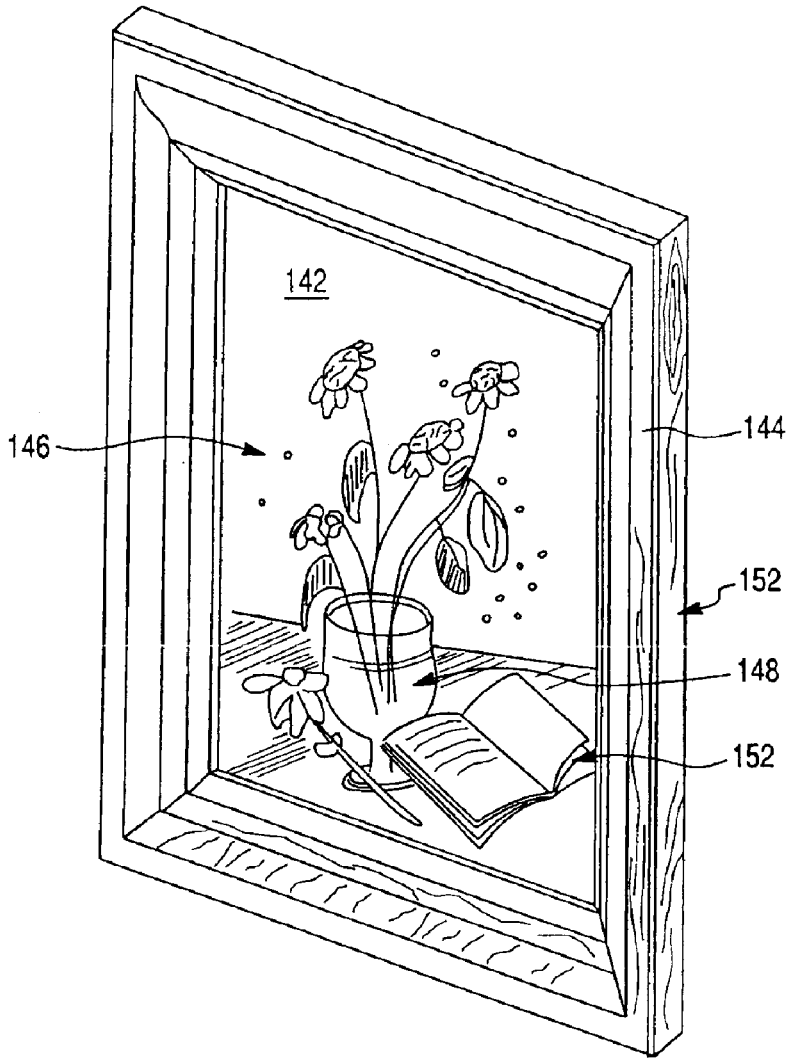
FIG. 25 is a perspective view of the molded casing of FIG. 23 after having been printed according to the present invention.
Figure 26:
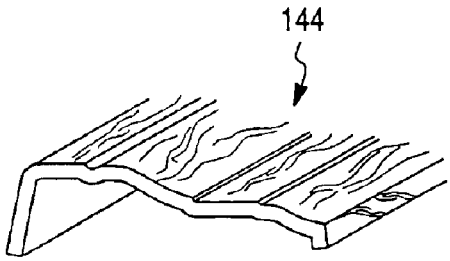
FIG. 26 is a fragmentary perspective view of the outer frame of FIG. 24 after having been printed according to the present invention.

For some applications, it may be desirable to print onto contoured portions (such as channels 30) of a molded object in a manner that suggests a frame surrounding an image, as best shown in FIGS. 23–26. It should be understood that the object may be formed from various substrates, including wood composite, post-formed MDF, molded fiberglass polymeric material, or pressed steel. As shown in FIGS. 23 and 24, a molded casing 140 includes a central planar portion 142 and a contoured outer frame 144. As shown in FIGS. 25 and 26, a wood grain pattern has been printed onto contoured outer frame 144 by ink jet printing. In addition, an image 146 of a flowerpot 148, flowers 149 and book 150 has been printed onto planar portion 142 using ink jet printing techniques disclosed herein. Image 146 may include various colors, just as with the image of baseball player 122 in FIG. 21. Image 146 does not extend onto outer frame 144. Thus, a fully "framed" picture is simulated after one printing operation onto molded casing 140.

Contoured outer frame 144 may also be printed to have a plain border, such as black or brown. The appearance of ornate, carved wood frames or wood inlays may also be simulated. It will be appreciated that an acceptable effect might still be achieved even if outer frame 144 is not contoured but rather planar with planar portion 142. For example, a similar image may be obtained on a flush door or planar tabletop. However, the contour of outer frame 144 often advantageously allows for the production of a more realistic looking frame. The same or a different image can be printed on the opposite surface.

As best shown in FIGS. 27 and 28, wainscot 160 may also be printed with a wood grain pattern and/or image in a similar manner, wherein central planar portions 162 may be printed with an image, and outer molded portions 164 may be printed with a wood grain pattern. Wainscot 160 may also include an outer portion 166. Of course, the entire surface (162, 164 and 166) may also be printed with the wood grain pattern, if desired by the consumer.

Figure 29:
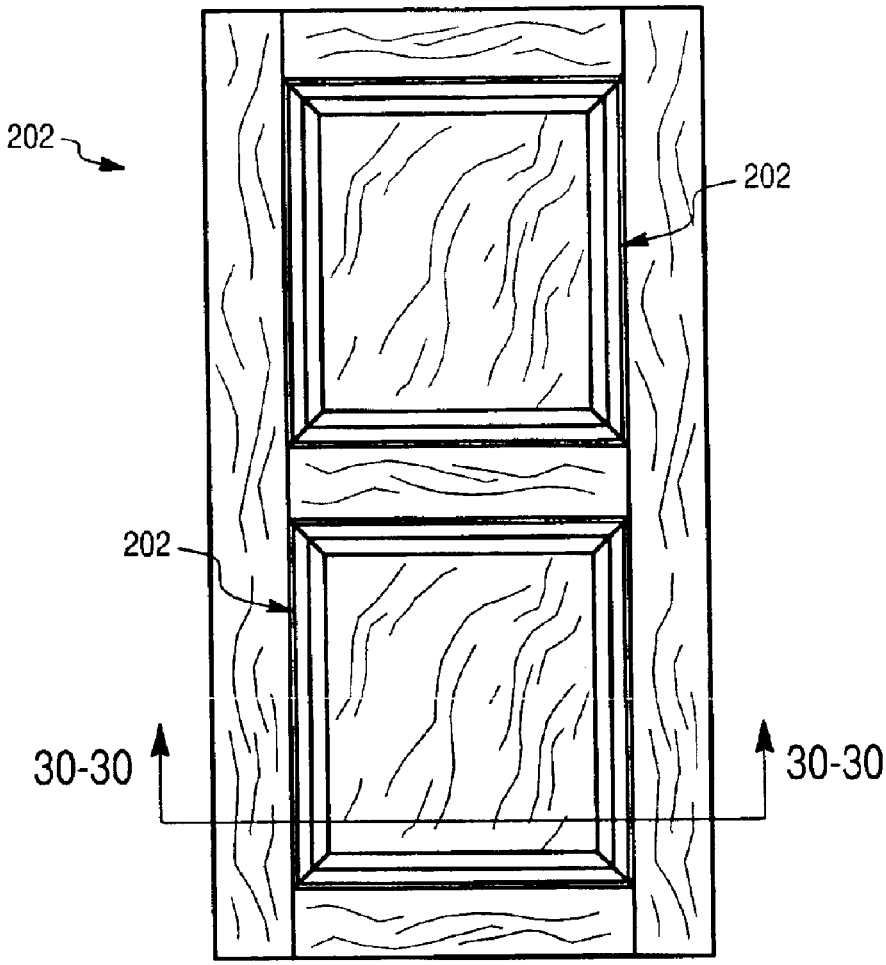
FIG. 29 is a front elevational view of a door facing having an ink jet printed sheet laminated thereon.
Figure 30:
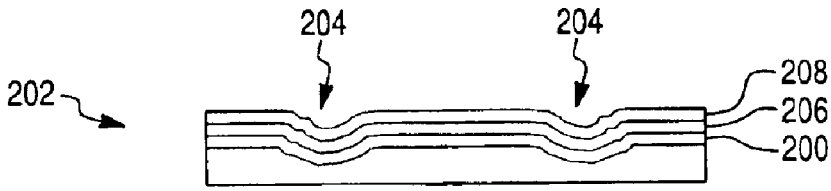
FIG. 30 is a sectional view taken along line 30—30 in FIG. 29 and viewed in the direction of the arrows.

In another aspect of the present invention, a synthetic printing sheet 200, such as made of Teslin™, is first molded onto a surface to be printed, such as door facing 202 as best shown in FIGS. 29 and 30. Preferably, printing sheet 200 has a color that is related to the dominant color (as explained above), or has a color that is the dominant color. In this way, application of ground coats may be obviated. Printing sheet 200 is laminated onto facing 202 using conventional techniques, such as with a membrane press or post molding press, either in-press or out of press.

Preferably, printing sheet 200 is comprised of a moldable, polyolefin material that stretches as it is formed onto facing 202. As such, sheet 200 does not wrinkle as it is being formed onto facing 202, even in contoured portions and molded corners, such as contoured portions 204 of facing 202. A suitable printing sheet is a Teslin™ sheet manufactured by PPG Architectural Finishes, Inc. of Pittsburgh, Pa. The Teslin™ sheet preferably has a thickness of about 7 millimeters.

Then, facing 202 is forwarded to a printing station (such as printing station 50) for ink jet printing the desired pattern or image 206 thereon. The surface of facing 202, covered by printing sheet 200, is particularly well suited for ink jet printing because printing sheet 200 has a uniform surface. Teslin™ material is designed as a printing surface. Facing 202 is ink jet printed as described above.

Alternatively, printing sheet 200 may first be ink jet printed with the desired pattern or image prior to laminating sheet 200 onto facing 202. Printing sheet 200 is ink jet printed as disclosed above. Then, sheet 200 is laminated onto facing 202 during an in-press lamination process. Applicants have found that the printed pattern stretches onto any molded or contoured portions 204 of facing 202 as sheet 200 stretches onto facing 202. In this way, the image quality is maintained, achieving a high quality print. Pre-printing of sheet 200, prior to lamination onto facing 202, is suitable for non-directional images and patterns. However, ink jet printing sheet 200 after it has been laminated onto facing 202 is preferred for more detailed images and multi-directional patterns. Further, sheet 200 is formed onto facing 202 and facing 202 is molded into its final contoured configuration in one molding step. Thus, printing and forming are accomplished in a cost efficient manner.

After printing sheet 200 is printed and formed onto facing 202 (either before or after ink jet printing sheet 200), a topcoat 208 may be applied to facing 202 as described above.

The present invention has been described herein in terms of several preferred embodiments. However, it should be understood that numerous modifications and variations to these embodiments would be apparent to those skilled in the art upon a reading of the foregoing description. For example, nearly any image that can be captured or stored digitally, or generated on a digital image generating system, can be applied to an object to be printed, such as a door skin or similar wood composite substrate. In addition, the disclosed invention may be applied to various objects, such as moldings, cabinet doors, wainscot panels, and the like.

Therefore, it is intended that any such modifications and variations comprise a part of this invention, provided they come within the scope of the following claims and their equivalents.

What is claimed is:

1. A method of printing an image on an object, comprising the steps of:

providing an object having an exterior surface having a planar portion and a channel recessed from the planar portion;

applying a first ground coat on the exterior surface;

drying the first ground coat; and applying droplets of ink on the dried ground coat to form an image, wherein the droplets are ejected from an ink jet printhead that is maintained a substantially constant distance from the plane of the planar portion of the object.

2. The method of claim 1, comprising the further step of applying a topcoat to the exterior surface after said applying droplets of ink step.

3. The method of claim 2, wherein the topcoat is a clear varnish.

4. The method of claim 1, comprising the step of applying a second ground coat to the channel after said applying a first ground coat step.

5. The method of claim 4, wherein said drying step includes drying the first and the second ground coats.

6. The method of claim 1, wherein said applying droplets of ink step includes ejecting droplets of ink having a diameter greater than about 20 $\mu$m.

7. The method of claim 6, wherein the droplets have a diameter of at least about 40 $\mu$m.

8. The method of claim 1, including the step of coating the exterior surface with a sealant prior to said applying a first ground coat step.

9. The method of claim 1, wherein the object is a door skin.

10. The method of claim 1, wherein the formed image is a wood grain pattern.

11. The method of claim 1, wherein the formed image is a color image.

12. The method of claim 1, wherein the channel includes a bottom recessed from the plane of the planar portion and a sloped sidewall extending from the bottom to the planar portion.

13. The method of claim 12, including the step of ejecting the ink droplets from the ink jet printhead to the bottom of the channel a maximum printing distance of about 15 mm or less.

14. The method of claim 12, wherein the sloped sidewall extends at an angle of 80 degrees or less relative to the plane of the planar portion.

15. The method of claim 1, comprising the further steps of:

applying droplets of ink on the dried ground coat on a first surface of the object; and applying droplets of ink on a second surface of the object.

16. The method of claim 15, wherein the second surface includes a ground coat, and said applying droplets of ink on the second surface step covers the ground coat.

17. The method of claim 1, including the step of:

applying the droplets of ink so that the image is formed as a wood grain pattern.

18. The method of claim 1, including the step of:

applying the droplets of ink so that the image is formed as a multi-colored image.

19. The method of claim 18, including the step of:

applying the ink in the colors cyan, magenta, yellow and black.

20. The method of claim 1, including the step of:

selecting as the object a member selected from the group consisting of passage doors, furniture doors, cabinet doors, closet doors, bifold doors, door frames, door skins, moldings, window frames, furniture components, tables, picture frames, molded wall paneling, and wainscot.

21. The method of claim 20, including the step of:

selecting as the object a member formed from the group consisting of medium density fiberboard, high density hardboard, natural wood, post-molded wood composites, molded fiberglass polymeric material and steel.

22. The method of claim 1, including the step of:

applying the ink droplets so that a first portion of the image extends in a first direction and a second portion of the image extends in a second direction differing from the first direction.

23. The method of claim 1, including the steps of:

applying as the ink a UV curable ink; and curing the ink by application of UV radiation.

24. The method of claim 1, including the step of:

applying the ground coat through spray application.

25. The method of claim 21, including the step of:

selecting as the ground coat a color that is the dominant color of the image to be formed.

26. A method of printing an image on an object, comprising the steps of:

providing an object having an exterior surface having a planar portion and a channel recessed from the planar portion;

applying a first ground coat on the exterior surface;

drying the first ground coat; and applying droplets of ink on the dried ground coat to form an image, wherein the droplets are ejected from an ink jet printhead that is maintained a substantially constant distance from the plane of the planar portion of the object throughout the ink application step.

27. The method of claim 26, comprising the further step of applying a topcoat to the exterior surface after said applying droplets of ink step.

28. The method of claim 27, wherein the topcoat is a clear varnish.

29. The method of claim 26, comprising the step of applying a second ground coat to the channel after said applying a first ground coat step.

30. The method of claim 29, wherein said drying step includes drying the first and the second ground coats.

31. The method of claim 26, wherein said applying droplets of ink step includes ejecting droplets of ink having a diameter greater than about 20 $\mu$m.

32. The method of claim 31, wherein the droplets have a diameter of at least about 40 $\mu$m.

33. The method of claim 26, including the step of coating the exterior surface with a sealant prior to said applying a first ground coat step.

34. The method of claim 26, wherein the object is a door skin.

35. The method of claim 26, wherein the formed image is a wood grain pattern.

36. The method of claim 26, wherein the formed image is a color image.

37. The method of claim 26, wherein the channel includes a bottom recessed from the plane of the planar portion and a sloped sidewall extending from the bottom to the planar portion.

38. The method of claim 37, including the step of ejecting the ink droplets from the ink jet printhead to the bottom of the channel a maximum printing distance of about 15 mm or less.

39. The method of claim 37, wherein the sloped sidewall extends at an angle of 80 degrees or less relative to the plane of the planar portion.

40. The method of claim 26, comprising the further steps of:

applying droplets of ink on the dried ground coat on a first surface of the object; and applying droplets of ink on a second surface of the object.

41. The method of claim 40, wherein the second surface includes a ground coat, and said applying droplets of ink on the second surface step covers the ground coat.

42. The method of claim 26, including the step of:

applying the droplets of ink so that the image is formed as a wood grain pattern.

43. The method of claim 26, including the step of:

applying the droplets of ink so that the image is formed as a multi-colored image.

44. The method of claim 43, including the step of:

applying the ink in the colors cyan, magenta, yellow and black.

45. The method of claim 26, including the step of:

selecting as the object a member selected from the group consisting of passage doors, furniture doors, cabinet doors, closet doors, bifold doors, door frames, door skins, moldings, window frames, furniture components, tables, picture frames, molded wall paneling, and wainscot.

46. The method of claim 45, including the step of:

selecting as the object a member formed from the group consisting of medium density fiberboard, high density hardboard, natural wood, post-molded wood composites, molded fiberglass polymeric material and steel.

47. The method of claim 26, including the step of:

applying the ink droplets so that a first portion of the image extends in a first direction and a second portion of the image extends in a second direction differing from the first direction.

48. The method of claim 26, including the steps of:

applying as the ink a UV curable ink; and curing the ink by application of UV radiation.

49. The method of claim 26, including the step of:

applying the ground coat through spray application.

50. The method of claim 46, including the step of:

selecting as the ground coat a color that is the dominant color of the image to be formed.

51. A method of printing an image on an object, comprising the steps of:

providing an object having an exterior surface having a planar portion and a channel recessed from the planar portion;

applying a first ground coat on the exterior surface;

drying the first ground coat; and applying droplets of ink having a diameter in excess of 20 $\mu$m on the dried ground coat to form an image, wherein the droplets are ejected from an ink jet printhead that is maintained a substantially constant distance from the plane of the planar portion of the object throughout the ink application step.

52. The method of claim 51, comprising the further step of applying a topcoat to the exterior surface after said applying droplets of ink step.

53. The method of claim 52, wherein the topcoat is a clear varnish.

54. The method of claim 51, comprising the step of applying a second ground coat to the channel after said applying a first ground coat step.

55. The method of claim 54, wherein said drying step includes drying the first and the second ground coats.

56. The method of claim 51, wherein said applying droplets of ink step includes ejecting droplets of ink having a diameter greater than about 20 $\mu$m.

57. The method of claim 56, wherein the droplets have a diameter of at least about 40 $\mu$m.

58. The method of claim 51, including the step of coating the exterior surface with a sealant prior to said applying a first ground coat step.

59. The method of claim 51, wherein the object is a door skin.

60. The method of claim 51, wherein the formed image is a wood grain pattern.

61. The method of claim 51, wherein the formed image is a color image.

62. The method of claim 51, wherein the channel includes a bottom recessed from the plane of the planar portion and a sloped sidewall extending from the bottom to the planar portion.

63. The method of claim 62, including the step of ejecting the ink droplets from the ink jet printhead to the bottom of the channel a maximum printing distance of about 15 mm or less.

64. The method of claim 62, wherein the sloped sidewall extends at an angle of 80 degrees or less relative to the plane of the planar portion.

65. The method of claim 51, comprising the further steps of:

applying droplets of ink on the dried ground coat on a first surface of the object; and applying droplets of ink on a second surface of the object.

66. The method of claim 65, wherein the second surface includes a ground coat, and said applying droplets of ink on the second surface step covers the ground coat.

67. The method of claim 51, including the step of:

applying the droplets of ink so that the image is formed as a wood grain pattern.

68. The method of claim 51, including the step of:

applying the droplets of ink so that the image is formed as a multi-colored image.

69. The method of claim 68, including the step of:

applying the ink in the colors cyan, magenta, yellow and black.

70. The method of claim 51, including the step of:

selecting as the object a member selected from the group consisting of passage doors, furniture doors, cabinet doors, closet doors, bifold doors, door frames, door skins, moldings, window frames, furniture components, tables, picture frames, molded wall paneling, and wainscot.

71. The method of claim 70, including the step of:

selecting as the object a member formed from the group consisting of medium density fiberboard, high density hardboard, natural wood, post-molded wood composites, molded fiberglass polymeric material and steel.

72. The method of claim 51, including the step of:

applying the ink droplets so that a first portion of the image extends in a first direction and a second portion of the image extends in a second direction differing from the first direction.

73. The method of claim 51, including the steps of:

applying as the ink a UV curable ink; and curing the ink by application of UV radiation.

74. The method of claim 51, including the step of:

applying the ground coat through spray application.

75. The method of claim 71, including the step of:

selecting as the ground coat a color that is the dominant color of the image to be formed.

* * * * *

UNITED STATES PATENT AND TRADEMARK OFFICE

CERTIFICATE OF CORRECTION

PATENT NO. : 7,001,016 B2
APPLICATION NO. : 10/405040
DATED : February 21, 2006
INVENTOR(S) : William R. S. Baxter et al.

It is certified that error appears in the above-identified patent and that said Letters Patent is hereby corrected as shown below:

In the Specification

Column 1, lines 7-8, change "35 U.S.C. §120" to read --35 U.S.C. § 119(e)--.

Signed and Sealed this
Twentieth Day of May, 2014

Michelle K. Lee

Michelle K. Lee
*Deputy Director of the United States Patent and Trademark Office*